US006504150B1

(12) United States Patent
Verentchikov et al.

(10) Patent No.: US 6,504,150 B1
(45) Date of Patent: Jan. 7, 2003

(54) METHOD AND APPARATUS FOR DETERMINING MOLECULAR WEIGHT OF LABILE MOLECULES

(75) Inventors: Anatoli N. Verentchikov, Boston, MA (US); Marvin L. Vestal, Framingham, MA (US); Igor P. Smirnov, Brookline, MA (US)

(73) Assignee: PerSeptive Biosystems, Inc., Framingham, MA (US)

( * ) Notice: Subject to any disclaimer, the term of this patent is extended or adjusted under 35 U.S.C. 154(b) by 0 days.

(21) Appl. No.: 09/579,989

(22) Filed: May 26, 2000

Related U.S. Application Data

(60) Provisional application No. 60/138,928, filed on Jun. 11, 1999.

(51) Int. Cl.[7] ..... H01J 49/40; H01J 49/42; H01J 49/26

(52) U.S. Cl. ..... 250/286; 250/281; 250/282; 250/287; 250/288

(58) Field of Search ..... 250/286, 281, 250/282, 287, 288

(56) References Cited

U.S. PATENT DOCUMENTS

| | | | | |
|---|---|---|---|---|
| 5,663,561 A | | 9/1997 | Franzen et al. | 250/288 |
| 6,204,500 B1 | * | 3/2001 | Whitehouse et al. | 250/287 |
| 6,315,266 B1 | * | 11/2001 | Nelson | 436/86 |
| 6,331,702 B1 | * | 12/2001 | Krutchinsky et al. | 250/281 |

FOREIGN PATENT DOCUMENTS

| | | | |
|---|---|---|---|
| EP | 0964427 | 12/1999 | H01J/49/40 |
| WO | WO 99/38185 | 7/1999 | H01J/49/40 |

OTHER PUBLICATIONS

J. Bell et al, Semiconductor–Doped Glass Waveguide Electro–Absorption Modulator 8030 Electronics Letters, Stevenage, Herts GB vo. 26 No. 14, Jul. 15, 1990.

Karas, M. et al., "Matrix–Assisted Ultraviolet Laser Desorption of Non–Volatile Compounds", International Journal of Mass Spectrometry and Ion Processes, 78 (1987).

Tanaka, K. et al., "Protein and Polymer Analyses up to m/z 100 000 by Laser Ionization Time–of–flight Mass Spectrometry", Rapid Communications in Mass Spectrometry, vol. 2, No. 8, (1988) 151–153.

Beavis, R. et al., "Factors Affecting the Ultraviolet Laser Desorption of Proteins", Rapid Communications in Mass Spectrometry, vol. 3, No. 7 (1989) 233.

(List continued on next page.)

*Primary Examiner*—Bruce Anderson
*Assistant Examiner*—Nikita Wells
(74) *Attorney, Agent, or Firm*—Andrew T. Karnakis

(57) ABSTRACT

A mass spectrometer instrument for determining the molecular weight of labile molecules of biological importance, in particular heavy molecules, such as proteins, peptides or DNA oligomers, is disclosed. The instrument includes a MALDI ion source that is enclosed in a chamber with an inlet for admitting a gas and an ion sampling aperture for limiting gas flow from the chamber. The elevated pressure of the source in the range from 0.1 to 10 torr causes low energy collisions between the gas and the ions that can cause rapid collisional cooling of the excited ions, thereby improving the stability of the produced ions. The formation of clusters of ions (e.g., protein ions) with matrix materials is broken without fragmenting the ions by increasing the downstream gas temperature to between 150 and 250° C. Operating the source at laser energy at least two times higher than the threshold value of ion formation and using a high repetition rate laser significantly improves sensitivity of analysis and speed of data acquisition.

44 Claims, 17 Drawing Sheets

OTHER PUBLICATIONS

Beavis, R. et al., "Cinnamic Acid Derivatives as Matrices for Ultraviolet Laser Desorption Mass Spectrometry of Proteins", Rapid Communications in Mass Spectrometry, vol. 3, No. 12 (1989) 432.

Kaufmann, R. et al., "Mass Spectrometric Sequencing of Linear Peptides by Product–ion Analysis in a Reflectron Time–of–flight Mass Spectrometer Using Matrix–assisted Laser Desorption Ionization" Rapid Communications in Mass Spectrometry, vol. 7, (1993) 902–910.

Kaufman, R. et al.,"Post–source Decay and Delayed Extraction in Matrix–assisted Laser Desorption/Ionization–Reflectron Time–of–Flight Mass Spectrometry. Are There Trade–offs?" Rapid Communications in Mass Spectrometry, vol. 10 (1996) 1199–1208.

Beavis, R. et al., "Velocity distributions of intact high mass polypeptide molecule ions produced by matrix assisted laser desorption", Chemical Physics Letters, vol. 181, No. 5, (1991) 479.

Verentchikov, A. et al., "Experimental Study of Ion Ejection Processes in Matrix Assisted Laser Desorption", Proceedings of the 40th ASMS Conference on Mass Spectrometry and Allied Topics, (1992) 360.

Zhou, J. et al., "Kinetic Energy Measurements of Molecular Ions Ejected into an Electric Field by Matrix–assisted Laser Desorption", Rapid Communications in Mass Spectrometry, vol. 6 (1992) 671.

Brown, R. et al., "Mass Resolution Improvement by Incorporation of Pulsed Ion Extgraction in a Matrix–Assisted Laser Desorption/Ionization Linear Time–of–Flight Mass Spectrometer", Analytical Chemistry, 67 (1995), 1998.

Vestal, M. et al., "Delayed Extraction Matrix–assisted Laser Desorption Time–of–flight Mass Spectrometry", Rapid Communications in Mass Spectrometry, vol. 9 (1995) 1044.

Karas, M. et al., "Laser Desorption Ionization of Proteins with Molecular Masses Exceeding 10 000 Daltons", Analytical Chemistry, 1988, 60, 2299–2301.

* cited by examiner

METHOD AND APPARATUS FOR DETERMINING MOLECULAR WEIGHT OF LABILE MOLECULES

This application claims priority on U.S. Provisional Application No. 60/138,928, filed on Jun. 11, 1999.

FIELD OF THE INVENTION

The invention relates generally to mass spectrometer (MS) instruments and specifically to mass spectrometers which utilize a matrix assisted laser desorption ionization (MALDI) ion source. More specifically, the invention relates to MALDI sources that are operated at an elevated pressure of from about 0.1 torr to about 10 torr, in order to assist in the MS analysis of labile molecules, such as proteins and peptides.

BACKGROUND OF THE INVENTION

The MALDI method, an established technique for analysis of biopolymers (see, e.g., M. Karas, D. Bachmann, U. Bahr and F. Hillenkamp, Int. J. Mass Spectrom Ion Processes 78 (1987), 53; Anal. Chem 60 (1988) 2299, K. Tanaka, H. Waki, Y. Ido, S. Akita, Y. Yoshida, T. Yoshida, Rapid Commun. Mass Spectrom. 2 (1988) 151–153 and R. C. Beavis and B. T. Chait, Rapid Commun Mass Spectrom 4 (1989) 233 and 432–440, is generally considered to be a soft ionization method with spectra containing mostly molecular ions, but both prompt and metastable fragmentation processes are known to occur. Fragmentation is most readily observed with reflecting analyzers and the technique known as "post-source decay" (PSD) has been developed to provide structural information on peptides and other small molecules (see, e.g., R. Kaufmann, B. Spengler and F. Lutzenkirchen, Rapid Com. M Sp 7(1993) 902–910 (PSD), and R. Kaufmann, P. Chaurand, D. Kirsch, B. Spengler, RCMS, 10 (1996) 1199–1208. Proteins and larger DNA oligomers often fragment extensively in a TOF mass spectrometer between the ion source and the detector, and in some cases the parent ion is poorly detectable in reflecting analyzers. Molecular ions may still dominate the spectra observed in a linear analyzer provided a significant fraction of such ions survives acceleration.

Not all of the ion excitation comes from the desorption process itself. Ions are excited while being dragged through the matrix plume by an accelerating electric field (see R. Kaufmann, P. Chaurand, D. Kirsch, B. Spengler, RCMS, 10 (1996) 1199–1208, R. C. Beavis and B. T. Chait, Chem. Phys. Lett., 181 (1991), 479, A. Verentchikov, W. Ens, J. Martens and K. G. Standing, Proc. 40$^{th}$ ASMS Conf.(1992) p.360, and J. Zhou, W. Ens, K. G. Standing and A. Verentchikov Rapid Commun. Mass Spectrom, 6 (1992) 671). As a result, the best performance, in so far as reduced fragmentation is concerned, is obtained right near the ionization/desorption threshold irradiance , which depends on a particular "sweet spot" on the matrix crystal.

Delayed ion extraction (DE) (see, e.g., R. S. Brown and J. J. Lennon Anal. Chem 67 (1995, 1998), and M. L. Vestal, P. Juhasz and S. A. Martin, Rapid Commun. Mass Spectrom 9(1995) 1044–1050) partially overcomes the fragmentation problem and makes the MALDI method more robust. In DE, application of the accelerating electric field is delayed so that the plume of neutral molecules desorbed by the laser has expanded sufficiently by the time the field is applied such that collisions are relatively improbable. As a result, stable ions can be obtained over a wider range of laser energy. Introduction of the DE technique strongly improved MALDI performance for peptides, medium mass proteins and DNA. However, performance, even when the DE method is applied, still deteriorates for proteins above 30 kD and mixed DNA larger than 60 mers. The peak shape is affected by unresolved losses of small groups and by adducts. Survival of molecular ion gets worse with size, particularly for DNA molecules. Additionally, the MALDI method is known to form clusters of protein ions with matrix molecules, which deteriorates the resultant spectrum.

The need exists for an improved MALDI source for an MS instrument that is capable of accurately determining the molecular weight of large molecules, particularly proteins and DNA oligomers. It is desirable that such a source achieve accurate molecular weight measurement by producing "clean" spectra through avoiding undue fragmentation and undesirable clustering.

SUMMARY OF THE INVENTION

In accordance with various embodiments of the invention, the MALDI technique has been extended for determining the molecular weight of labile molecules, thereby making the technique particularly useful for molecules of biological importance such as peptides, proteins, and DNA oligomers. The invention overcomes the limitations of the prior art with respect to apparatus and methods employing the MALDI technique and thus extends the utility of this technique for labile biopolymers by avoiding uncontrolled fragmentation in some cases, and also undesirable clustering with matrix and impurity molecules. Both of these effects have in the past limited the utility of the MALDI technique for reliably determining molecular weights of biopolymers larger than about 30,000 Da.

The invention is based on the recognition that low energy collisions of excited ions with neutral molecules can cause rapid collisional cooling and thus relax internal excitation and improve the stability of MALDI-produced ions. In accordance with a feature of the invention, recent experimental studies by the inventors have found that losses of small groups and backbone fragmentation are practically eliminated at a MALDI source pressure of around 1 torr. In accordance with another feature of the invention, at room temperature and at gas pressures above 0.1 torr to around 10 torr, the formation of clusters of protein ions with matrix molecules can be efficiently broken without fragmenting proteins by increasing the downstream gas temperature between 150 and 250° C. It has also been found desirable to control the temperature in the ion source chamber below 50° C. to avoid sample degradation. Stabilization of ions and removal of matrix complexes improves the quality of protein spectra. Isotope limited resolution can be achieved for the 47 kD protein enolase.

Once metastable fragmentation of proteins is prevented by gas collisions, the qualitative aspects of the ionization process in MALDI become highly insensitive to laser fluence. Over a wide range of laser power (almost one decade) spectra remain strikingly similar. In accordance with another feature of the invention, operating at a high laser energy in combination with intermediate gas pressure significantly increases ion signal intensity. Further optimization of ion signal intensity and speed of data acquisition can be achieved by also simultaneously operating the laser at a high repetition rate and controlling the scan rate of the sample plate without saturating the data acquisition system. The invention thus provides for an instrument system that is highly insensitive to variations of laser energy and sample preparation technique.

An objective of this invention is to control and reduce the fragmentation of molecular ions produced by MALDI.

Another objective is to control and reduce the amount of clustering of neutral molecules on molecular ions produced by MALDI.

Other objectives are to improve the sensitivity, resolution, and mass accuracy for molecular weight determinations on large molecules by MALDI-TOF mass spectrometry.

Another objective is to provide apparatus and methods for determining the molecular weight of larger DNA fragments, including mixtures of such fragments which can be used to determine DNA sequence.

These objectives are accomplished by providing apparatus and methods for controlling the pressure and temperature of the neutral gas within the MALDI ion source.

Preferred embodiments are described which are particularly applicable to introduction of ions to a time-of-flight mass spectrometer orthogonally to the direction of ion transport from the source. Other embodiments are described which are also applicable to more conventional "co-axial" time-of-flight mass spectrometry in which direction of ion introduction is substantially parallel to the direction of ion motion in the TOF analyzer.

BRIEF DESCRIPTION OF THE DRAWINGS

Other objects, features and advantages will occur to those skilled in the art from the following description of the preferred embodiments of the invention and the accompanying drawings, in which.

DETAILED DESCRIPTION OF THE PREFERRED EMBODIMENTS OF THE INVENTION

Figure 1:
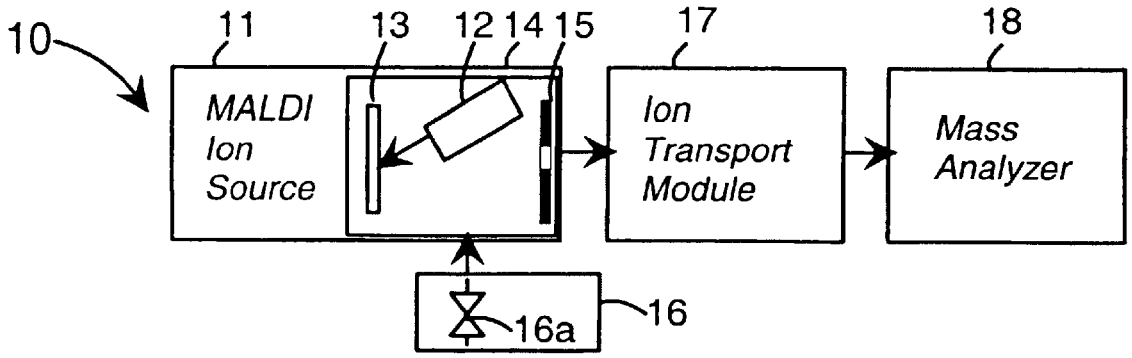
FIG. 1 is a block diagram of an embodiment of the invention.

Referring to FIG. 1, in brief overview, a preferred embodiment of a mass spectrometer instrument 10 for determining the molecular weight of labile molecules includes a MALDI ion source 11 having a laser 12, a sample plate 13, an ion source chamber 14 surrounding the sample plate and including an ion sampling aperture 15, a gas inlet module 16 for introducing a flow of gas into the region adjacent to the sample plate, a valve 16A between the gas inlet module 16 and the ion source chamber 14, and an ion transport module 17 coupling the source 11 to a mass spectrometer (MS) 18.

In operation, a sample of labile molecules, such as proteins or DNA oligomers, is incorporated into a crystalline matrix material, deposited onto the sample plate 13 and exposed to a focused photon beam generated by laser 12. Laser pulses generate a plume of ions and neutral molecules from the sample. The plume slowly expands into the buffer gas. The gas pressure in the ion source chamber 14 is regulated by adjustment of the flow of inert gas supplied by inlet module 16 through adjustment of the valve 16A. The balance of gas flow and differential evacuation (described below) defines the gas pressure in the ion source chamber 14. At the time of the laser pulse, the gas pressure in chamber 14 is maintained at least in a range of from about 0.1 to about 10 torr. Ions generated from the laser pulse become internally relaxed in collisions with the inert gas, thereby stabilizing the ions and thus eliminating fragmentation, which is a typical problem for conventional MALDI. Ions slowly migrate through the ion sampling aperture 15 towards the ion transport module 17, being gently pulled by a moderate electric field and by gas flow into the transport module. The aperture 15 limits gas flow from the chamber 14 into the transport module 17, and together with the differentially pumped ion transport module, adapts the gaseous ion source operating at elevated pressure to the lower pressure requirements of the MS spectrometer 18. As a result, gas pressure in ion source 11 can be controlled over a wide range without affecting the operation of the MS analyzer 18. To reduce losses, the ion transport module 17 incorporates focusing ion optics elements and may include temperature regulation (for example using controlled heating elements) which breaks complexes of sample ions and matrix material by moderate heating. Complexes can also be broken by application of a moderate electric field.

One preferred form of the MS spectrometer 18 which is well suited for analysis of sample ions over a wide mass-to-charge (M/Z) ratio of heavy, singly charged ions, is a time-of-flight mass spectrometer (TOF MS). Low initial ion energy and the absence of metastable fragmentation help to achieve low chemical background noise and good resolution of mass spectra in a TOF MS instrument. However, it is possible to extend the principles of the MALDI ion source generation of the present invention to directly interface with other mass analyzers, such as quadrupole, ion trap, Fourier Transform or magnetic sector mass analyzers. For example, if a high-repetition rate laser is used, the ion beam produced is a nearly continuous beam. For operation with a quadrupole mass analyzer, using a lower frequency RF field applied to the quadrupole extends the mass range of the ions being analyzed.

Figure 2:
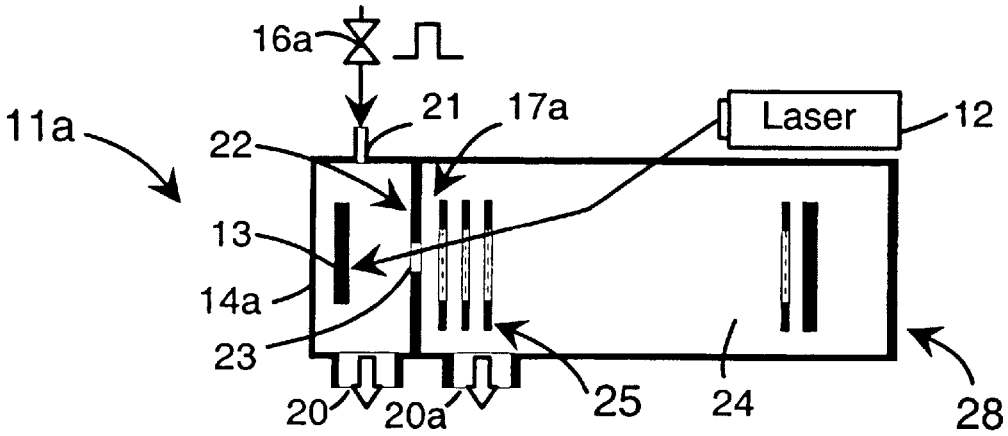
FIG. 2 is a schematic diagram of an embodiment of the invention with an in-line TOFMS.

Referring to FIG. 2, one embodiment of this invention comprises MALDI ion source 11*a* differentially pumped via port 20 connected to a vacuum pump (not shown), and supplied with a pulsed gas flow by pulsed valve 16A through port 21. In this embodiment, the ion transport module 17*a* contains a separating electrode 22 which contains an aperture 23. Aperture 23 limits the gas flow into a vacuum chamber 24 of an in-line linear TOF MS 28, having separate pumping port 20A connected to a vacuum pump (not shown) and a set of meshes 25 for providing pulsed acceleration of the beam.

In operation, the inert gas pulses are synchronized with shots from laser 12 to expose the plume generated by the MALDI ion source 11*a* to at least about 100 mtorr (preferably from about 0.1 to about 10 torr) local gas pressure at the time of plume expansion. Using a pulsed gas inlet reduces the average load on the pumping system and allows maintaining sufficient vacuum in the TOF analyzer. For example, with a peak pressure of 300 mtorr and a duty cycle of gas load <1%, a vacuum better than $10^{-6}$ torr can be maintained in the TOF analyzer 28 by a pump with a moderate pumping capacity of 300 l/s while keeping the size of the aperture 23 to a reasonable size of 1 mm. Without a pulsed gas source the size of the aperture would have to be reduced to about 0.1 mm, which could result in ion loss and hence reduced sensitivity.

The kinetic (translational) energy of the ions is relaxed in gas collisions. Ions travel with the gas flow through aperture 23, and are sampled into the vacuum chamber 24. Ion sampling may be assisted by applying a moderate electric field between the sample plate 13 and the aperture 23. The size of the aperture 23 may be approximately 1 mm or slightly less, a size still sufficient to ensure complete transport of the ion beam, as the laser spot is much smaller (about 0.1 mm). The energy of the ions is damped in collisions with the gas, while the packet of ions is still short (within a few millimeters in length). Once the ion packet is sampled into an intermediate stage of differential pumping an electric pulse is applied to eject ions into a TOF mass spectrometer. Pulsed acceleration can provide time focusing of such ion packets to obtain an adequate resolution (R) in the range of R~1000 even with a linear TOF analyzer of a moderate size. The resolution can be improved with the use of a longer analyzer and employing ion mirror.

The following is a brief rationale of a time focusing scheme, based on expert estimation of the beam parameters. The resolution of a linear TOFMS analyzer is limited by simultaneous spatial spread ($\Delta x$), velocity spread ($\Delta V$) and time spread ($\Delta t$) of the pulsed ion beam. Since a pulsed acceleration is applied, time spread ($\Delta t$) is eliminated. It is expected that collisional damping in a gas jet reduces ion velocity spread ($\Delta V$) below thermal velocity. Velocity spread limits resolution of a linear TOF analyzer by the following computation: $\Delta V/V*A/L$, where V is the ion velocity in free flight, A is the length of the acceleration field and L is the length of the field free region. The ion velocity can be calculated assuming mass=10 kD and acceleration potential=10 kV. Then V=10000 m/s. Assuming A=30 mm, L=1 m and $\Delta V$<300 m/s the resolution limit is R>1000. The spatial spread of a few millimeters can be focused using methods described by Wiley and McLaren (W. C. Wiley and I. H. McLaren, Rev. Sci. Instum, 26, 1150, 1955). The resolution of spatial focusing is limited as described in this reference to $8*(A/\Delta x)^2$, where A is the length of the acceleration field. Assuming $\Delta x$=3 mm and A=30 mm (as in the previous calculation) the expected resolution is in the order of R~1000. Such resolution is comparable to existing methods and is well accepted for TOF MS of heavy molecules since, in any event, resolution is limited by isotope distribution of heavy ions.

Figure 3:
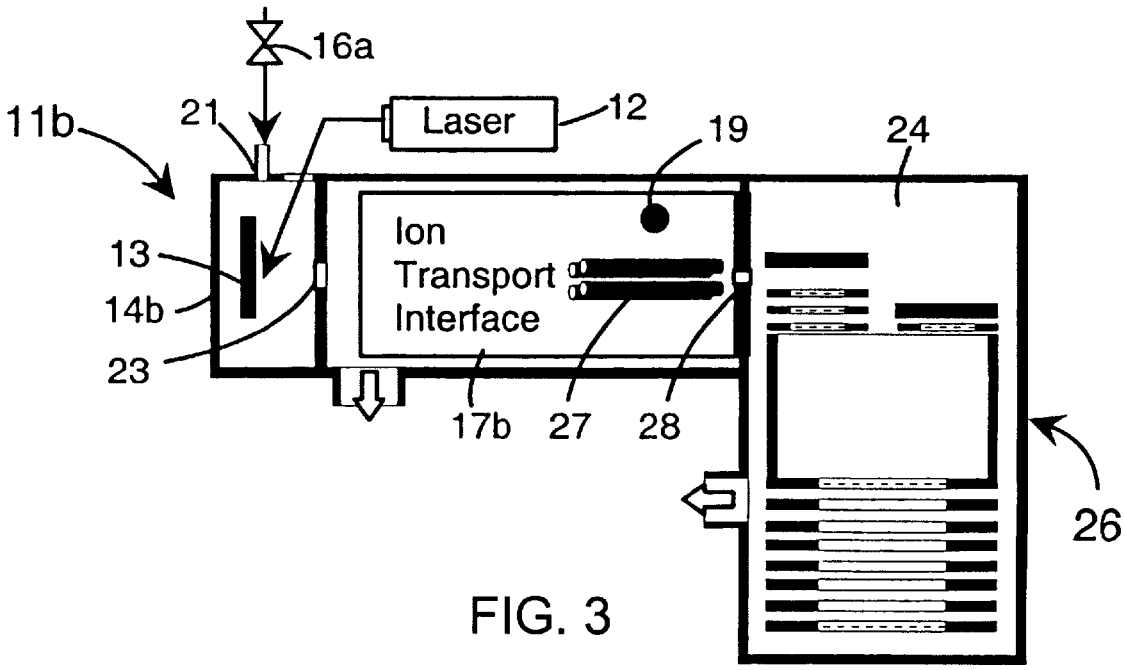
FIG. 3 is a schematic diagram of an embodiment of the invention with an orthogonal TOFMS.

Referring to FIG. 3, another embodiment of the invention comprises MALDI source 11*b* filled with the gas at a constant pressure supplied from inlet module 16 through port 21. The inlet gas flow is typically regulated by adjustable valve 16A. The gas pressure in ion source chamber 14*b* is measured by a separate vacuum gauge (not shown) and is defined by a balance of the inlet gas flow and conductivity of the limiting aperture 23. As in the FIG. 2 embodiment, a weak electric field applied between the sample plate 13 and the aperture 23 assists ion sampling through ion transport module 17*b*, and then into vacuum chamber 24 of a time-of-flight spectrometer 26, which in this instance is an analyzer operating with orthogonal injection of ions passed through ion transport module 17*b* (o-TOF MS). As before, the aperture 23 allows independent control over the gas pressure in the ion source, thus relaxing the ions' internal energy. Ion transport module 17*b* is heated by a temperature source 19, to transfer heat to the gas flow and, thus, to break complexes (clusters) formed between ions and matrix molecules. It is also desirable in certain instances to regulate the temperature in the ion source chamber 14*b* to avoid sample degradation, for example, by means of cooling the ion chamber 14*b* or sample plate 13. In order to provide sufficient heat exchange the residence time of the ions within the ion transport module 17*b* is prolonged by choosing a weaker electric field, higher gas pressure and a longer transport system.

Since the pulsed ion packet experiences a substantial broadening, the o-TOF is no longer synchronized with the laser pulses. Instead, a quasi continuos beam is formed by using a high repetition rate laser, running the laser at an increased fluence, and by slowing the ion beam. Such a mode of operation strongly enhances the ion signal and accelerates spectra acquisition. The inventors have found that a MALDI ion source can produce a substantial current. In the absence of a strong external field, the ion beam is driven by its own space charge. It is advantageous to reduce space charge by inducing a controlled axial ion flow, which can be achieved by either a gas flow or a weak axial electric field. Radial spreading of the beam can be effectively prevented by the use of a radio frequency quadrupole 27. By applying a weak repelling potential between the quadrupole 27 and an exit aperture 28, the pulsing nature of the beam is completely smoothed. The resultant continuous ion beam with a completely damped energy distribution perfectly fits the operation of an o-TOF mass spectrometer. The continuous beam is converted in a known manner into ion packets accelerated orthogonal to the initial direction of the beam. Ion packets are formed at a high repetition rate to efficiently utilize the beam by minimizing ion losses. Typical efficiency, or "pulser duty cycle", of an o-TOF MS is in the order of 10 to 30%. Lower sensitivity, as compared to an in-line TOF MS as shown in FIG. 2, is well compensated by a uniform resolution and linear mass calibration.

Figure 4A:
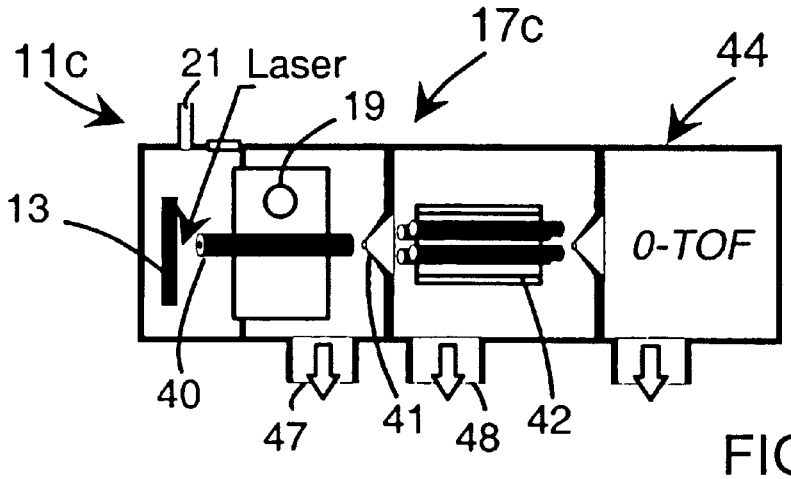
FIGS. 4A–4C are schematic diagrams of various interfaces for an o-TOFMS useful in this invention.

Referring to FIGS. 4A, B and C, multiple embodiments of the ion transport module of this invention are shown. The type of transport module is selected according to the range of gas pressure applied to the MALDI source. The pressure requirements can vary depending on the wavelength of the laser, properties of the sample and of the matrix material. The pressure needs to be regulated in order to cool ions at a sufficient rate. The necessary rate is defined by the stability of the ions, and the temperature of the ions ejected from the sample. After testing a large number of practical combinations of wavelength, matrix material and sample nature, however, it was found that pressures of around 1 torr give the best results. The wavelength range of available lasers is wide. However, infrared (IR) desorption is softer than ultraviolet (UV), but IR lasers are often problematic when used in commercial systems. It was also found that the temperature of the MALDI ions does not depend on laser irradiance and ion properties, but is mostly defined by the chemical composition of the matrix. The nature of the matrix fixes the temperature of phase transfer. For example, the temperature of ions ejected from an alpha cyano matrix was found to be about 500° C., and from 3-HPA about 350° C. The thermal stability of a few nucleotide, peptide and protein ions was measured, and it was found that all of the peptides and proteins had similar stability curves. The decomposition rate (defined as the rate at which $NH_3/H_2O$ groups were lost) was proportional to the size of the molecule. As a result, larger proteins had more of a 17/18 loss peak. The performance at 1 torr was good, as exemplified by FIGS. 10–12. Also, nucleotides were found to be much less stable, as exemplified by FIG. 15. However, the stability of nucleotides was found not to be limited by thermal instability per se, since those ions are usually produced from a very "cold" matrix.

In one particular embodiment (FIG. 4A), the gas pressure in the ion source 11*c* is selected to be in the range of from 3 torr to 1 atm. The two-stage differentially pumped transport module 17*c* includes a long tube 40 and a multipole guide 42 separated by an aperture 41. The tube 40 is a few mm in diameter and is heated to approximately 200° C. to break any clusters of ions with matrix molecules that may form during laser desorption. The inventors have also discovered that the transmission of the tube suddenly drops at pressures below a certain value. The threshold value may be calculated and corresponds to the product of P times d (P*d), which for this embodiment approximately equals 50 mm*torr, where P is the gas pressure in torr and d is the tube diameter. As a result, such a transport module operates at a high gas flow through the tube 40 and thus requires an additional pumping stage via port 48 to maintain vacuum in the back end o-TOF mass spectrometer 44. The multipole guide 42 is a radio-frequency (RF) only multipole guide which enhances ion transmission of the final stage of the transport module. The inventors have verified experimentally that gas pressure in the MALDI source could be raised up to atmospheric pressure, as long as the diameter of the tube 40 is proportionally reduced to maintain vacuum in the TOF mass spectrometer 44. For example, a tube of 0.4 mm diameter was used at 1 atmosphere pressure in the MALDI source. However, for a few tens of tested matrices gas pressure above 10 torr have been found to accelerate cluster formation, but have not improved collisional cooling of proteins and DNA. The main advantage of using the tube on the transport system is to protect the transport system from contamination by matrix material. The transport system of this embodiment tolerates volatile matrices. In particular, a water matrix was used and successful results obtained at a pressure of 1 atm.

When a UV laser is used at 1 atmosphere source pressure, the use of solid matrices such as, α-cyano-4-hydroxycinnamic acid (CHCAC), 3-hydroxypicolinic acid, 2,5-dihydroxy-, 2,3,4-trihydroxy-, and 2,4,6-trihydroxyacetophenones, 4-nitrophenol, 6-aza-2-thiothymine, 2,5-dihydroxybenzoic acid, sinapinic acid, dithranol, 2-aminobenzoic acid, 2-(4-hydroxyphenylazo) benzoic acid (HABA), ferulic acid, succinic acid, etc., have been successfully demonstrated. However, cluster formation makes operating at an atmospheric pressure regime inferior to a pressure range from 0.1 to 10 torr. When an IR laser is used at 1 atmosphere source pressure, the same matrices as above may be used, as well as volatile materials such as water, water/alcohol mixtures, water and polyalcohols (such as ethylene glycoles, glycerines etc.), different aromatic amines, containing hydroxyl functional group (such as 2-hydroxypyridine), etc. All matrices both for UV and IR may contain some additives of salts with ammonia counter ions or different alkyl ammonia derivatives to prevent alkali metal adducts formation both for peptides/proteins and for DNA analysis. Use of an IR laser at 1 atmosphere pressure allows the use of liquid matrices flowing in a continuous stream with flow rates in the microliter to milliliter per minute range. In this instance, liquid matrices, such as water, water-alcohol mixtures and glycerol, have been successfully demonstrated.

Figure 4B:
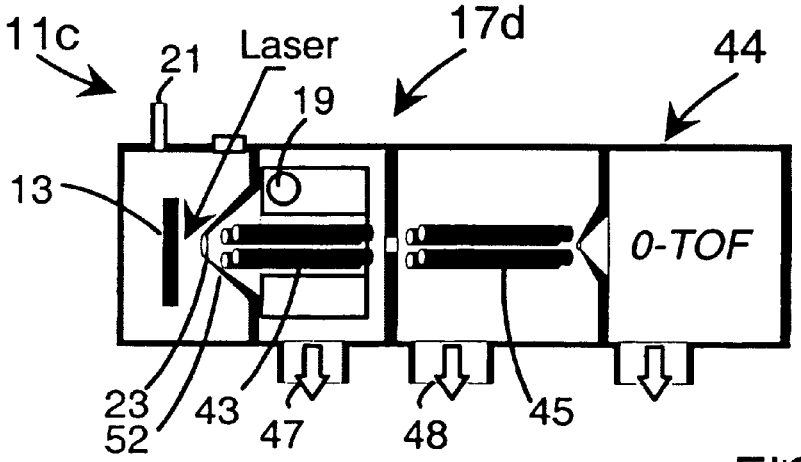

In another particular embodiment shown in FIG. 4B, the gas pressure in the MALDI source 11*c* is adjustable to between about 100 mtorr and about 3 torr. To accommodate such pressure in the source, the transport module 17*d* includes two differentially pumped stages (created by connecting suitable pumps to ports 47 and 48), and RF-only multipole ion guides in the form of quadrupoles are used to enhance transmission of both stages. The quadrupole guides 43, 45 are heated to 150 to 200° C. in order to avoid the build up of films and the charging of those films as well as to break up any clusters of ions with matrix material or other impurities. An applied pressure of about 1 torr provided efficient relaxation of internal energy of heavy proteins and medium size DNA. To avoid electrical discharges at such pressure, the amplitude of the RF signal in the first multipole 43 is maintained below 250V, and the RF frequency is kept between 10 kHz and 1 MHz. Ions with an M/Z of ~150,000 were transported at a frequency of 300 kHz with the use of the quadrupole guides. If the quadrupoles were operating in vacuum, such an RF signal would cause rejection of low mass ions below about 1 kD. However, at a pressure of 1 torr the effect of collisional damping stabilizes medium mass ions and substantially lowers the "cut-off mass" of low mass ions to approximately an M/Z of ~200. The effect is not crucial for observation of heavy ions, but is useful for monitoring matrix ions and characteristics of ion formation. The inventors have found that the two-stage system with quadrupole guides allows raising the pressure from around 80 millitorr with a single quadrupole, up to a few torr, without significant ion losses. Optionally, a conical shaped separating electrode 52 helps spatially focus the ions and also eases passing the laser beam to sample plate 13.

Figure 4C:
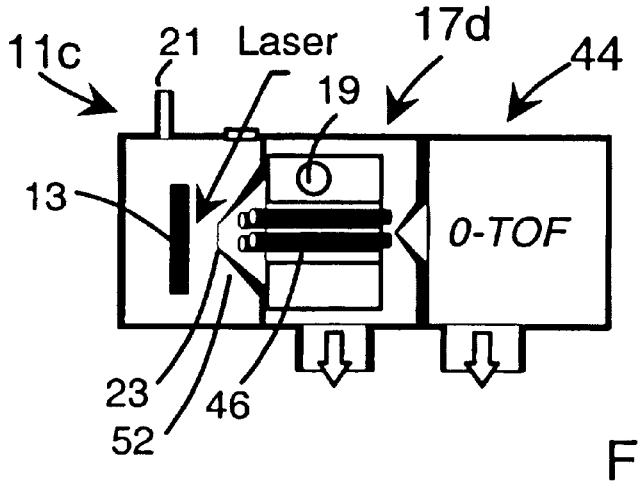

In another particular embodiment shown in FIG. 4C, the gas pressure in the MALDI source 11*c* is in the range from about 30 mtorr to about 300 mtorr, and the transport module 17*e* is formed by a single multipole guide 46. Once again, the conical shaped separating electrode is used. Such a pressure range is sufficient for collisional relaxation of peptide ions, but it is marginal for protein ions. Pressure effects are discussed below in the experimental section.

With all the above described transport modules, it is often desirable to use an additional electrode to provide protective shielding in conjunction with ion transport through the exit aperture 23. In case of the long tube interface (FIG. 4A), the tube plays the role of the exit aperture. Its primary purpose is to allow independent control of gas pressure in the MALDI ion source, while maintaining vacuum in the TOF analyzer. The inventors have realized that the electrode 22 with the aperture 23 also provides an important function of a protecting shield. Such a shield helps to protect the multipole guide against build-up of matrix film. This function is particularly desirable when operating the module with a slow ion beam. The inventors have found experimentally that charging in the quadrupole guide causes rejection of heavy ions. The build up and charging of matrix films on the electrode 22, 52 do not cause rejection or mass discrimination of the ion beam. An additional electrode can be used to protect the sample plate 13 from heating when the tube 40 or the multipole guides 42, 43, 45 or 46 are heated to break up clusters. This is important to prevent rapid evaporation of the matrix material or thermal decomposition of the sample.

Experimental Results

Collisional Cooling of Peptide Ions

Figure 5:
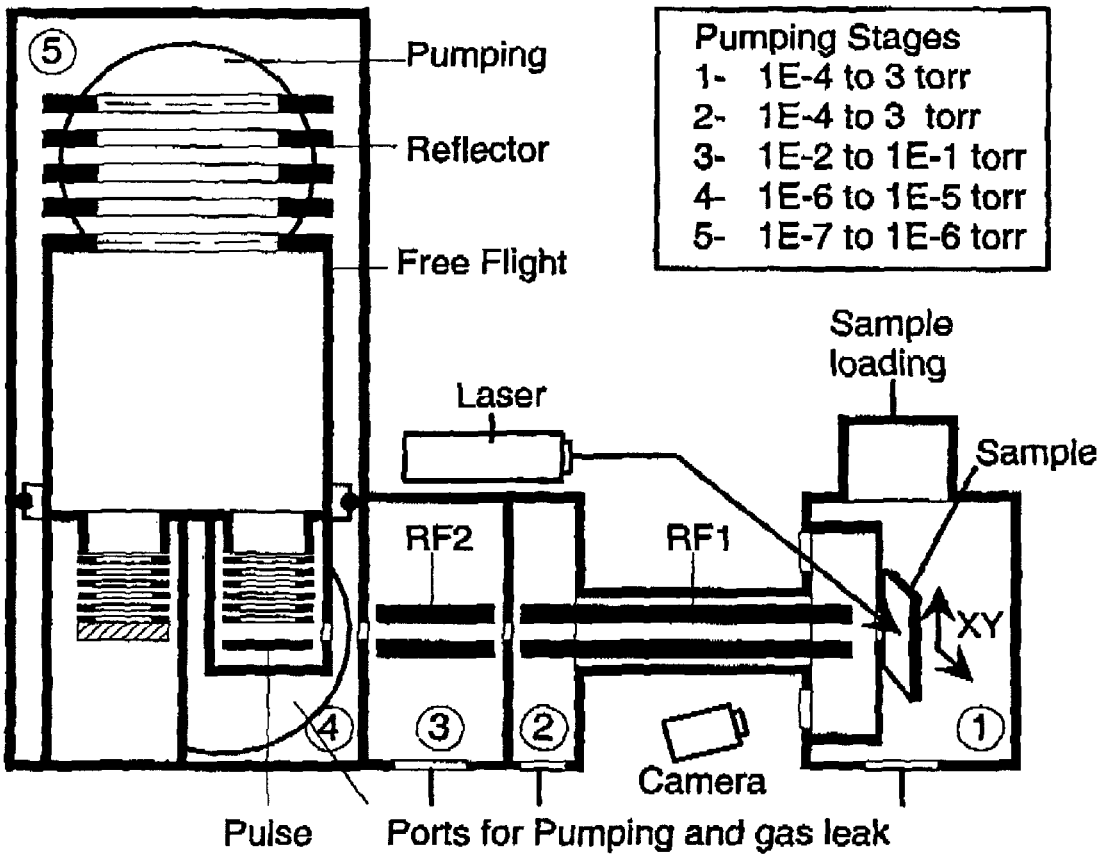
FIG. 5 is a schematic diagram of an apparatus used to conduct experimental studies in accordance with the invention.

With one preferred embodiment shown in FIG. 5 we have shown that ionization without fragmentation could be achieved at moderate laser energies (1 to 3 $\mu$J/pulse) when gas pressure in the ion source was above 100 mtorr. In order to make a systematic study of the effects of ion source gas pressure, an additional turbo pump was attached to the ion source and additional controlled leak of nitrogen was used to adjust pressure in a second quadrupole. While pressure in the ion source varied from $10^{-4}$ to 1 torr, a necessary degree of collisional damping was provided in the transport system by maintaining 10 to 30 mtorr pressure in the second RF-only quadrupole.

Although fragmentation of peptides was found to be a function of gas pressure, the other experimental conditions had to be adjusted to verify that the pressure effect is not caused by difference in transmission or different efficiency or by in-source collisional induced dissociation (CID). Voltage difference per stage was adjusted as U(V)=1+50*P(torr). Absence of CID was verified at pressures of 10 mtorr and above. The degree of fragmentation did not depend on voltage gradients near operating conditions. At lower—(0.1 mtorr) pressure, the energy of ions entering the second quadrupole was below 2 eV, i.e. it should not cause appreciable amount of fragments. The same sample was deposited on multiple spots of the sample plate, and the same laser energy was used for the entire run. In those experiments the nitrogen laser ran at a repetition rate of 20 Hz. The laser energy of about 2 $\mu$J/pulse is approximately 1.5 times higher than the threshold of ions observation. Peptide samples were prepared in a-cyano-4-hydroxy-cinnamic acid (CHCA) matrix at concentrations from 10 to 100 pmol/$\mu$l.

Figure 6A:
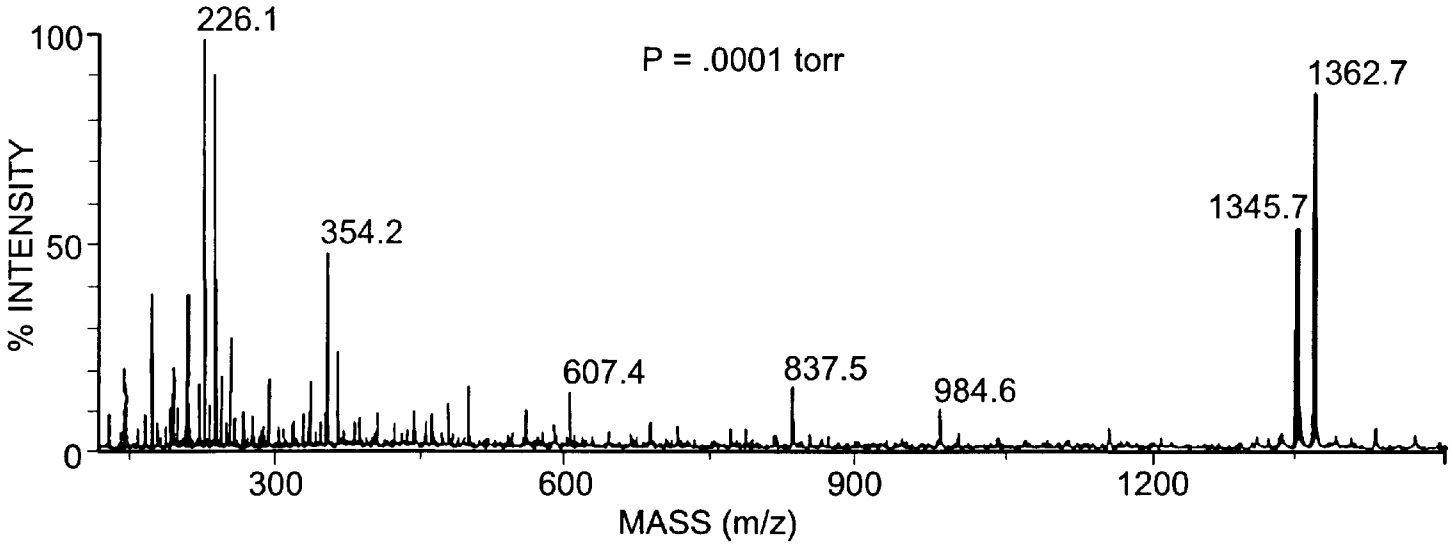
FIGS. 6A–6D are time-of-flight mass spectral comparisons demonstrating the effect of collisional cooling as a function of gas pressure in the source, useful in understanding this invention.
Figure 6B:
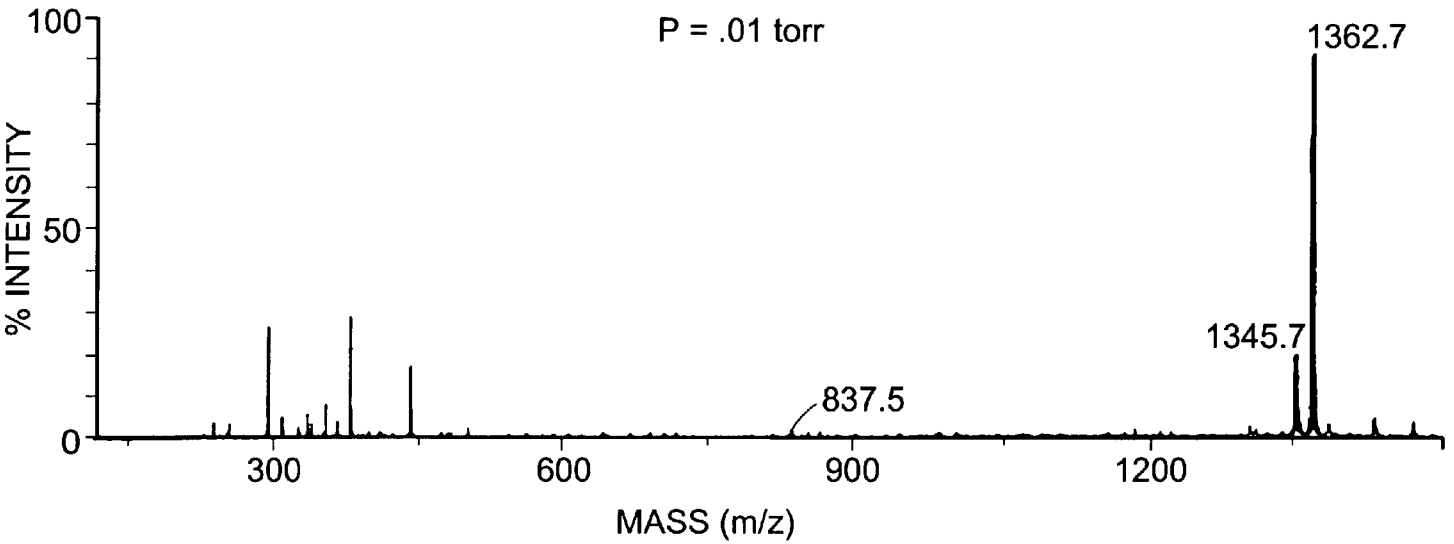
Figure 6C:
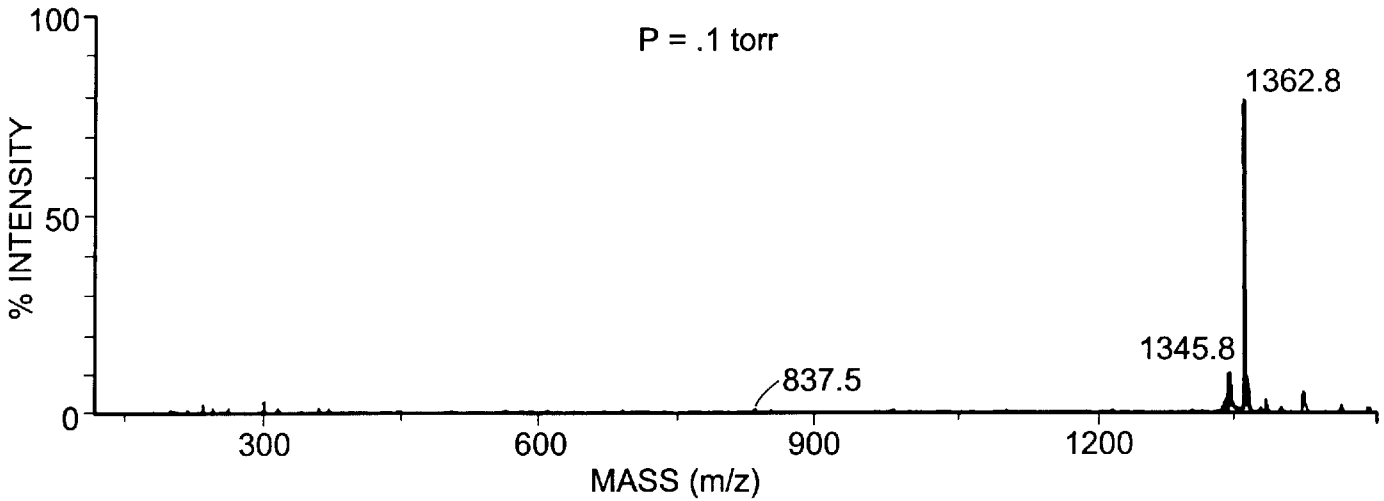
Figure 6D:
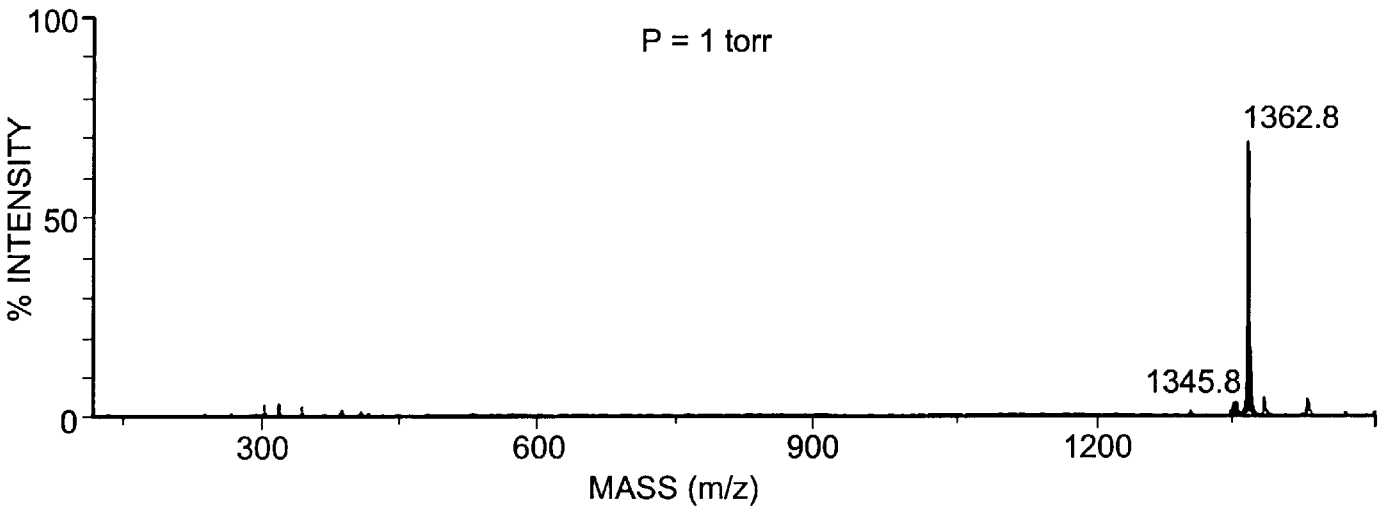

Effects of collisional cooling of peptide ions are illustrated by spectra of peptide substance P acquired at various gas pressures (FIGS. 6A–D) of 0.1 mtorr (FIG. 6A), 10 mtorr (FIG. 6B), 100 mtorr (FIG. 6C) and 1 torr (FIG. 6D). At low pressure (0.1 mtorr in FIG. 6A) there is a substantial amount of small fragments. In addition, the peak of 17 loss (representing the loss of an $NH_3$ group) is almost as high as the molecular peak. With an increase of the pressure, the amount of fragments decreases. Both the most prominent backbone fragment $a_7$ (838 amu) and the fragment corresponding to loss of $NH_3$ group, are strongly suppressed at 100 mtorr (FIG. 6C).

Figure 7A:
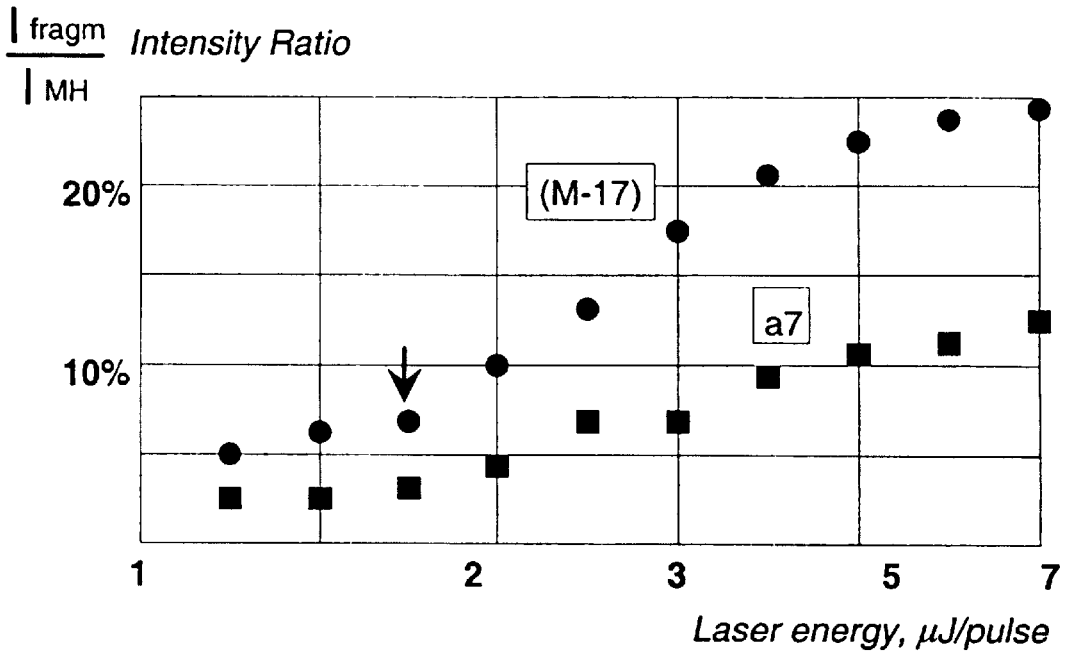
FIGS. 7A and 7B are plots demonstrating the effect of laser energy, useful in understanding this invention.
Figure 7B:
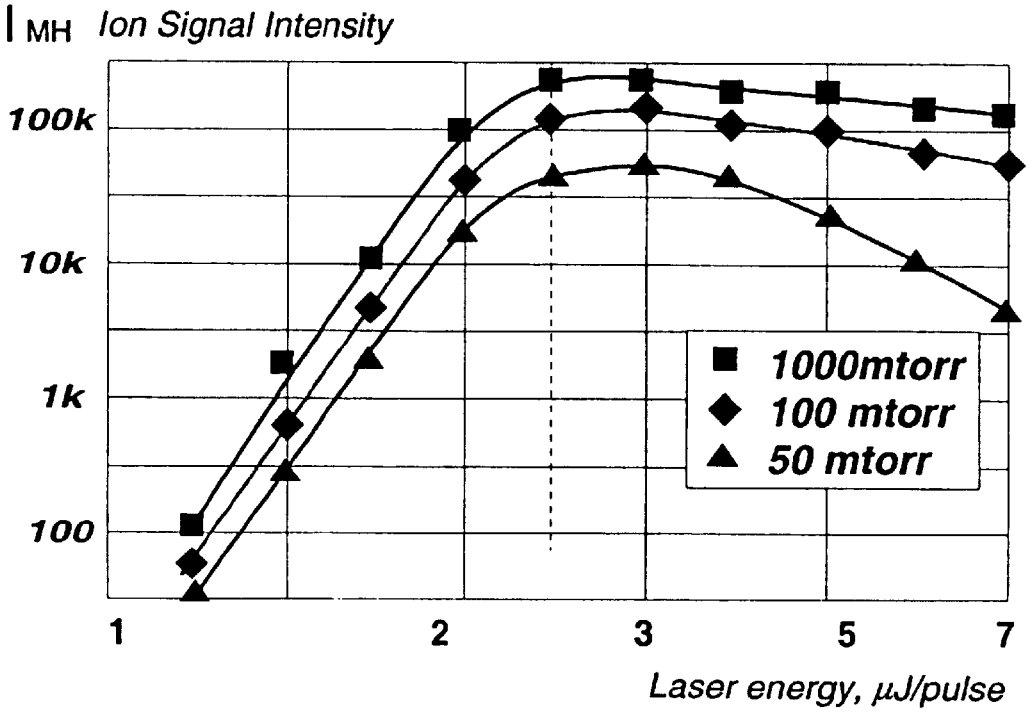

The need for cooling appears to be dependent on laser energy, and varied with peptide size and composition. The effect of laser energy is demonstrated on the example of substance P in FIG. 7A, which demonstrate peptide Substance P in CHCA matrix at 0.1 torr gas pressure. FIG. 7A is a semi-logarithmic plot of relative intensity of M-17 and A7 backbone fragment; and FIG. 7B is a bi-logarithmic plot of signal intensity vs. laser energy. In those experiments, a 20 Hz Nitrogen laser was utilized. 10 pmole/$\mu$l samples were prepared in CHCA matrix. The relative intensity of fragments a7 and M-17 increases with laser energy. Both fragments are increasing proportionally, as do other medium mass fragments, not presented on the drawing. Since the MH—$NH_3$ peaks are close to the molecular peak and easy to assign, these can be used as an indicator of the process harshness.

There is less fragmentation at lower laser energy. In order to get cleaner spectra one typically operates close to threshold, a strategy quite common for conventional MALDI in vacuum. That, however, would compromise sensitivity. An important feature of the present invention contravenes conventional thinking by utilizing collisional cooling in the source in order to operate at higher laser energy and thus improve sensitivity and signal stability. The intensity of the signal could be improved by almost four orders of magnitude once the laser energy is adjusted to about 3 times higher than the threshold value for ion production as shown in FIG. 7B. As described below, the signal intensity is further increased by using a high repetition rate laser. As a result, ion production at intermediate pressure provides much higher signal and faster data acquisition compared to conventional DE MALDI in vacuum.

High Repetition Rate Laser at a Higher Energy per Pulse

Figure 8A:
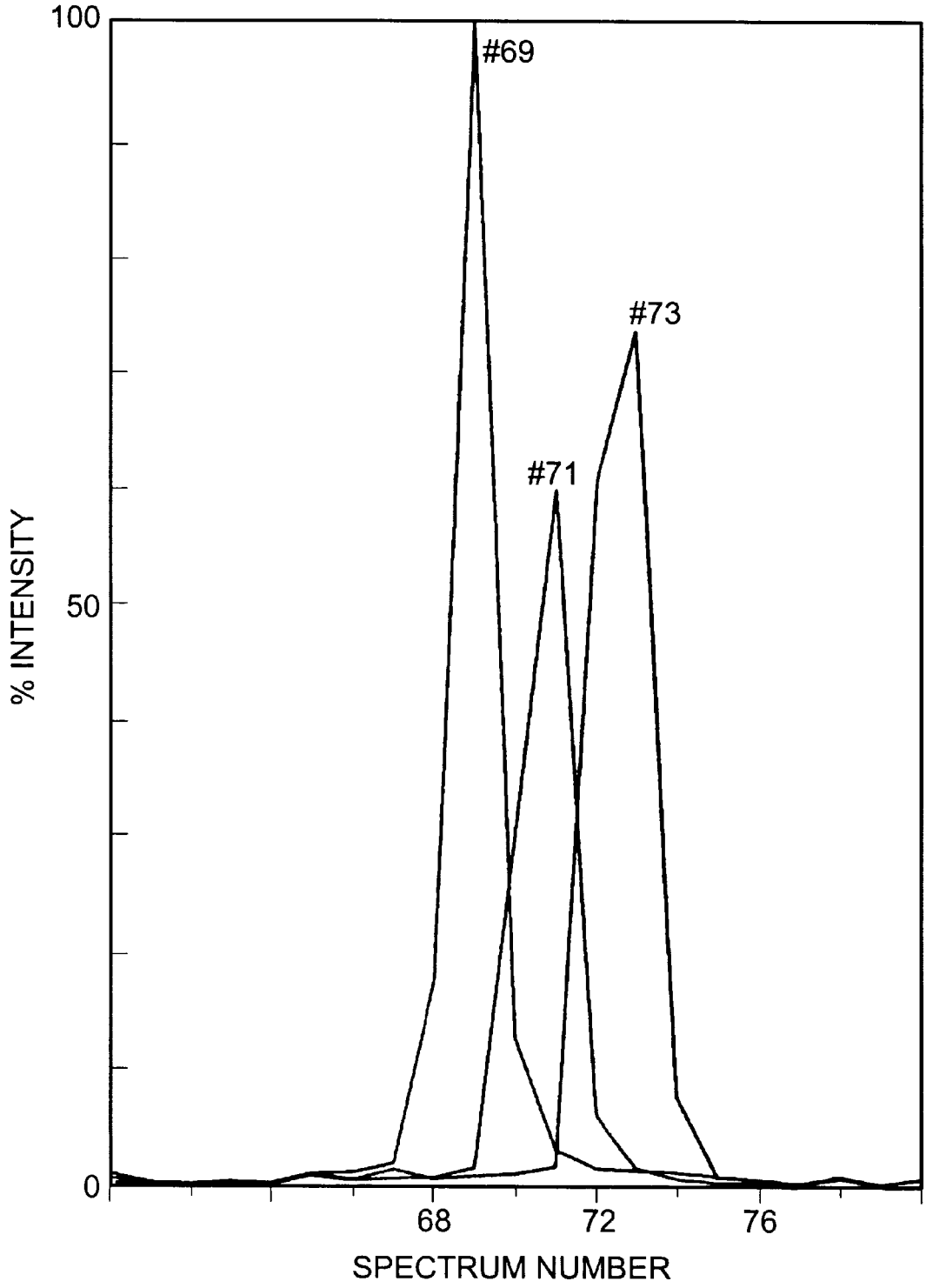
FIG. 8A shows the total ion current profile and FIGS. 8B–8D are a series of TOF spectra acquired with moving a sample plate and operating a Nd-YAG laser (355 nm) at a repetition rate of 2 kHz, useful in understanding this invention.
Figure 8B:
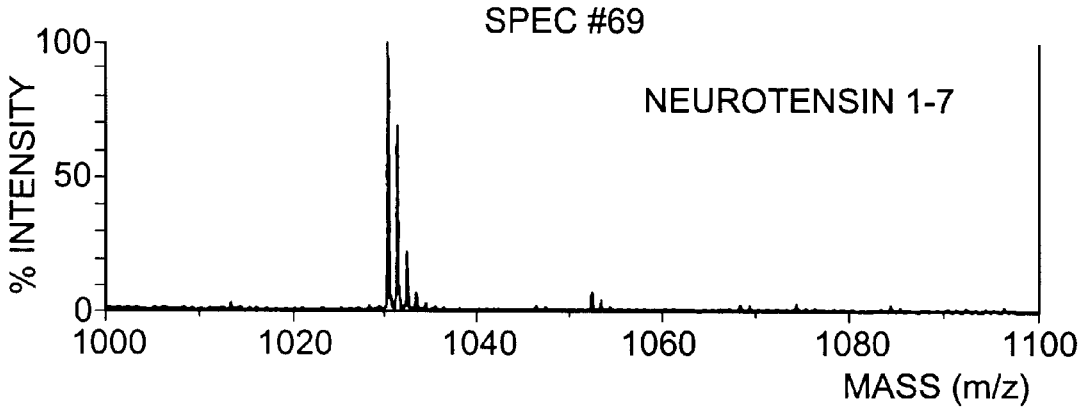
Figure 8C:
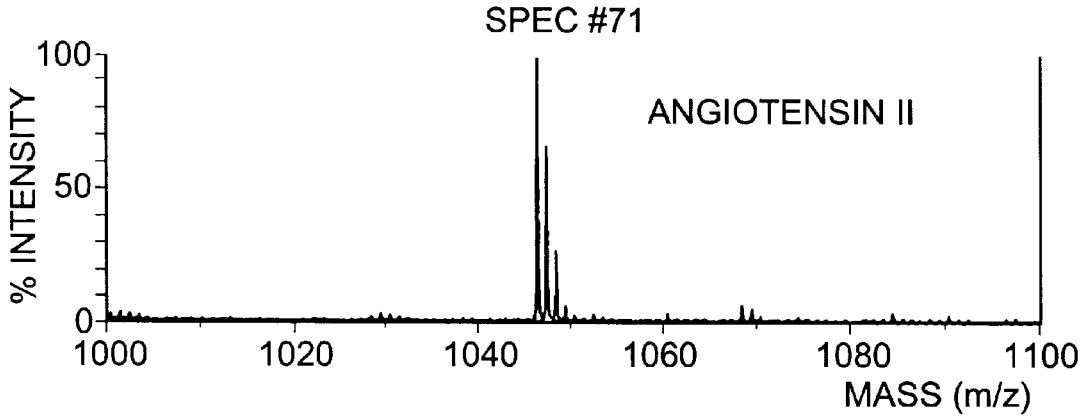
Figure 8D:
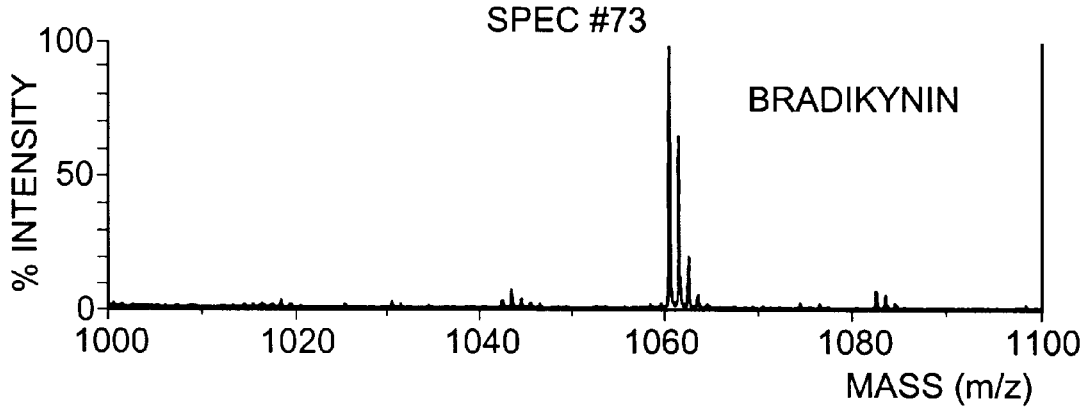
Figure 9:
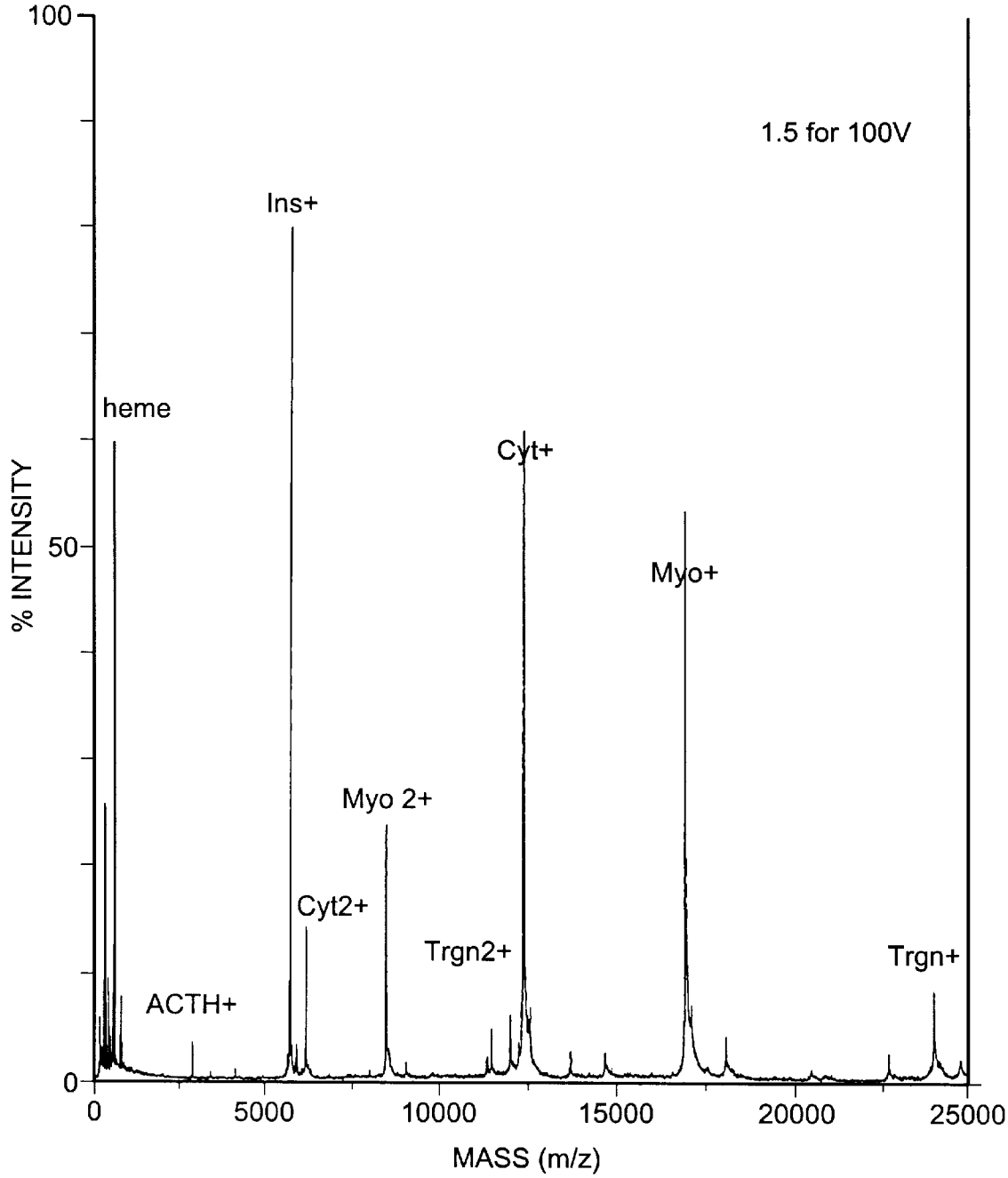
FIG. 9 is TOF spectrum of a protein mixture at 1 pmol per component, useful in understanding this invention.

The laser energy could be lowered when signal losses are compensated by repetition rate of the laser. The effect was first observed with the nanolaser "Nano UV355" (Uniphase, Calif.), running at uncontrolled Q-switch at 6 kHz and at a laser energy of about 0.6 mJ/pulse. A combination of low energy and divergence in the horizontal plane made it difficult to focus the laser beam tightly enough. With the use of a cylindrical lens the fluence was barely over the threshold for CHCA matrix. For other matrices the fluence was not sufficient. The scheme works perfectly with a more powerful high repetition laser, EPO-5000 Nd-YAG at 355 nm with an active Q-switch, which allows controlling the repetition rate by an external triggering device. Up to 2 kHz repetition rate the laser can sustain constant energy per shot, comparable to the energy of a nitrogen laser. The laser energy is sufficient to reach maximum signal for all tested matrices. For the whole range from 2 Hz to 2 kHz the signal intensity was found to grow proportionally with the laser repetition rate, provided the sample is constantly refreshed under the laser beam by moving the sample plate. The sample stage (plate holder) is moved by stepper motors, and the software controlling the stepper motors was programmed for continuous scanning in a serpentine pattern. At a 3 mm/sec linear speed any 0.15 mm spot was exposed no longer than for 100 shots at 2 kHz laser repetition rate. Such scanning speed is safe since a single spot of CHCA matrix was found to last for 400 to 500 shots within one decade of laser energy. High repetition rate of laser operation dramatically accelerates data acquisition. Even at 0.25 sec acquisition time and for 100 fmol samples, spectra have good statistics and signal to noise ratio (FIGS. 8B–8D). Such rapid acquisition allows continuous scanning across multiple samples. FIG. 8A shows total ion current acquired in a constant sweep mode. For small and medium mass proteins it takes a few seconds to acquire smooth spectra (FIG. 9). In all further experiments, the high frequency laser was employed.

The described method of the present invention of MALDI source operation at elevated pressure is more robust and easier to automate than the conventional way of acquiring spectra in DE MALDI, where an experienced user has to select so-called sweet spots on the deposited sample and reject data from 'bad' spots. Using intermediate pressure in the ion source allows laser energy to be increased without fragmenting ions, thereby permitting a more uniform response across the sample. As a result, the sample plate can be automatically moved and spectra can be acquired at a high repetition rate without user feedback. Such a mode is advantageous for acquiring profiles across gels and tissues or for automatic screening of multiple samples.

It is desirable to further accelerate data acquisition and thus to increase the throughput of the system. Although commercial lasers allow even higher repetition rates (i.e., up to tens of kHz), prior to the inventors' experiments described herein, it was unknown how high the repetition rate of the laser could be increased without degrading spectral quality. As shown above, sample degradation can be avoided by moving the sample plate at appropriate speed and all tested ion transport interfaces showed no signs of saturation, i.e., signal response was proportional to laser rate. Apparently, the upper limit of laser repetition rate was set by saturation of the counting data acquisition system employed, a time-to-digital converter (TDC). The limitation could be avoided by using a more expensive analog data acquisition system such as fast averaging transient recorder (TR). However, good results can be obtained with a TDC if laser repetition rate is used as an adjustment parameter in order to increase the dynamic range of the TDC. A lower rate would provide good statistics of strong peaks without saturating TDC, and a higher rate would do likewise for weak peaks in the spectra.

Operation at high repetition rate provides another advantage, namely the pulsed beam is smoothed and is better compatible with mass analyzers designed for continuous beams.

Cooling Protein Ions

Figure 10A:
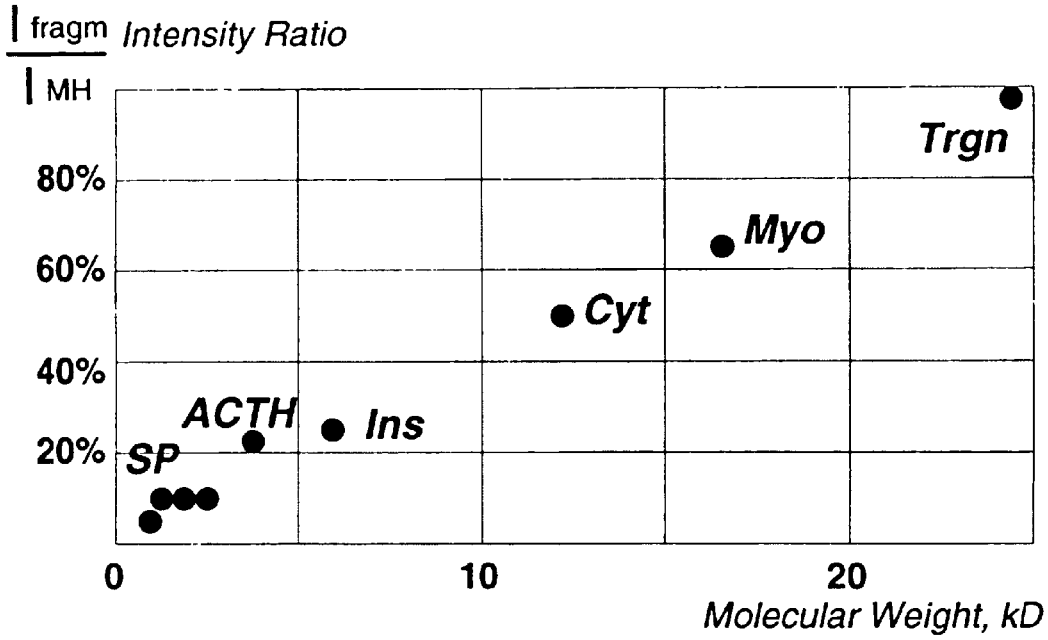
FIGS. 10A and 10B are plots demonstrating the effect of protein size on degree of fragmentation, useful in understanding this invention.
Figure 10B:
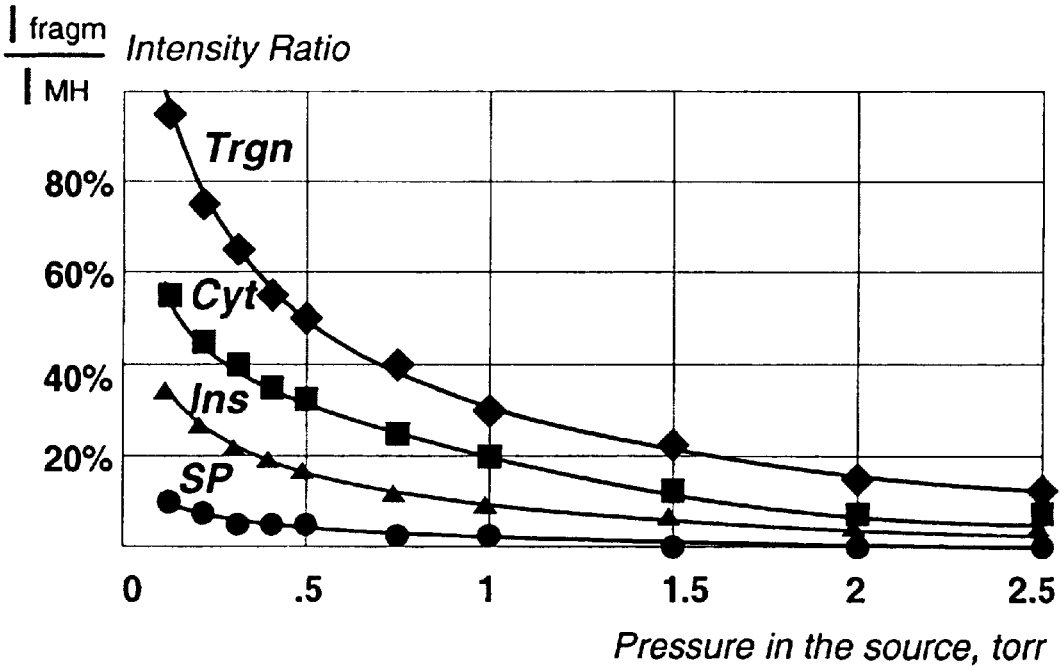

Cooling of protein ions appeared to be very similar to cooling of peptides. However, even at moderate laser energy the requirements for cooling become more demanding as the size of the protein increases. FIG. 10A shows relative intensity of M-17 fragment vs. protein size, and FIG. 10B shows relative intensity of fragments vs. gas pressure in the ion source. The relative intensity of M-17 fragment is much higher for proteins, compared to peptides (FIG. 10A). Those data were acquired at 100 mtorr pressure and a laser energy of 2 $\mu$J/pulse, which is approximately 1.5 times higher than the threshold value for ionization. For small size peptides there is a strong variation of stability. At larger size, the variations are averaged and the probability of small group loss becomes proportional to the size. It looks likely that excitation, i.e., internal energy per amino acid, does not depend on the protein size and there is an equal probability per amino acid, capable of loosing an $NH_3$ or $H_2O$ group. The most important practical aspect of the plot is that small group losses become a more serious problem with the increase of protein size. A similar problem was observed in ion traps and reflecting TOF mass spectrometers with a MALDI source operating in a vacuum. Even in a linear TOF the low-mass side of protein peaks is smeared because of small group losses.

The problem is effectively resolved by further increase of gas pressure in the source. Ion source gas pressure increases to about 1–3 torr substantially reduces small group losses for proteins of all sizes (FIG. 10B).

Figure 11A:
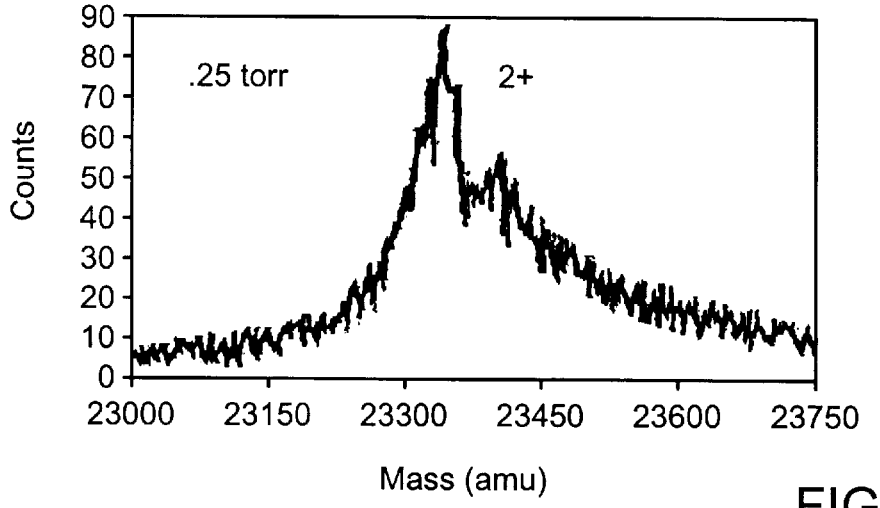
FIGS. 11A–11C are a series of TOF spectra for proteins, useful in understanding this invention.
Figure 11B:
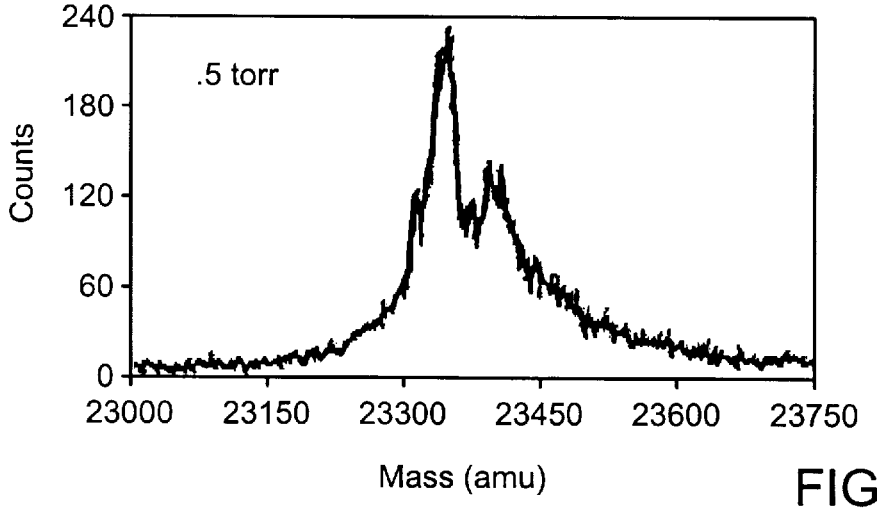
Figure 11C:
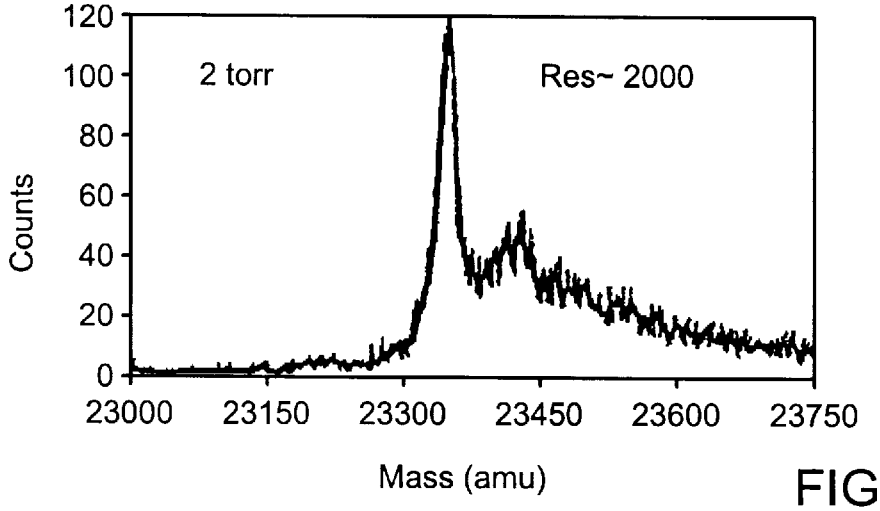
Figure 12:
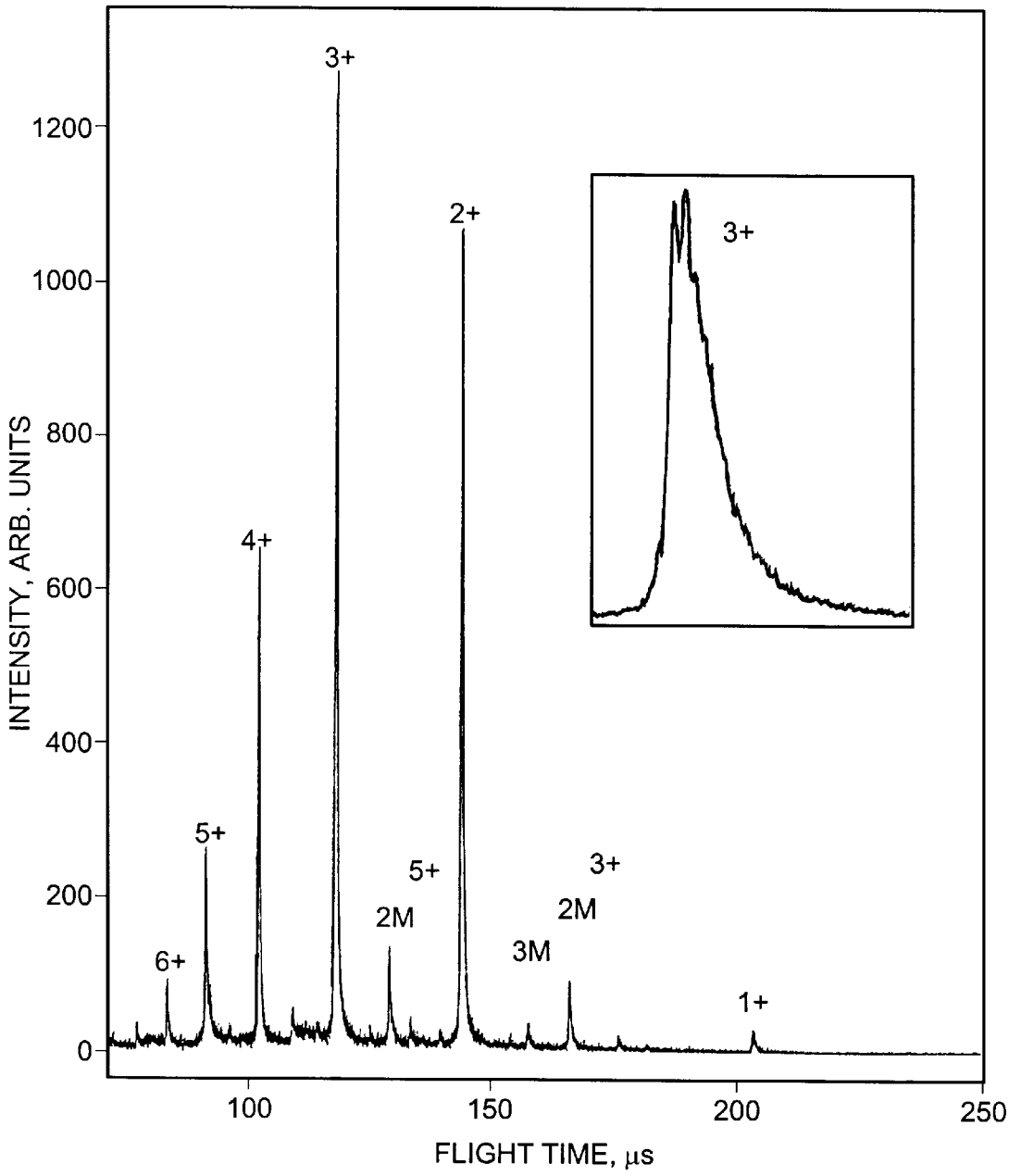
FIG. 12 is a TOF spectrum of the 66 kD protein BSA. The insert panel expands the area of the triply-charged peak to demonstrate the heterogeneity of BSA.

Collisional cooling efficiency strongly improves at gas pressure around a few torr. As a result, good quality spectra can be acquired at higher laser energy and thus at higher signal intensity. Collisional cooling improves the shape of heavier proteins, as is observed (FIGS. 11A–C) using the example of east enolase, a 47 kD protein, demonstrating collisional cooling at various gas pressure in the source: 0.25 torr (FIG. 11A), 0.5 torr (FIG. 11B) and 2 torr (FIG. 11C). Fragmentation is reduced and mass resolution is improved at higher pressure (FIG. 11C). Several unresolved small loss peaks smear the left side of the peak at 0.25 mtorr (FIG. 11A). Those satellites are strongly suppressed at higher pressure of 0.5–2 torr (FIGS. 11B and C). Isotope limited resolution of R~2000 can thus be obtained. For a number of tested larger proteins (monoclonal mouse IgG, transferrin and ferritin) resolution appeared to be in the order of 80 to 120. The effect could be related to heterogeneity of proteins. In the case of BSA (66 kD) (FIG. 12) heterogeneity forms were resolved, which indicates resolution in excess of 1000 for this 66 kD protein.

Breaking Clusters

Figure 13A:
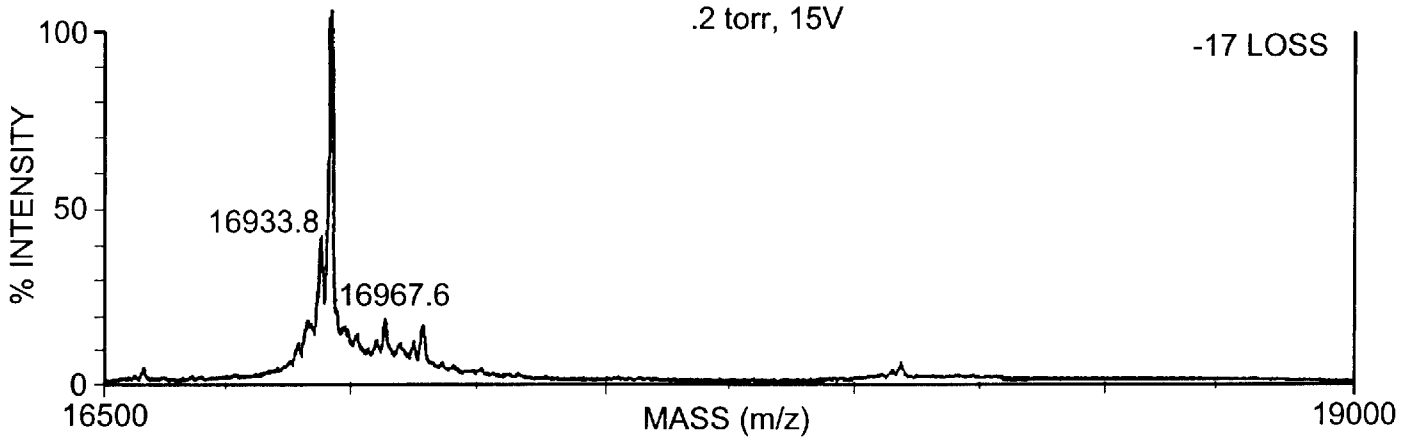
FIGS. 13A–13D are a series of TOF spectra demonstrating relative effects of cooling and cluster formation at various gas pressure in the ion source, useful in understanding this invention.
Figure 13B:
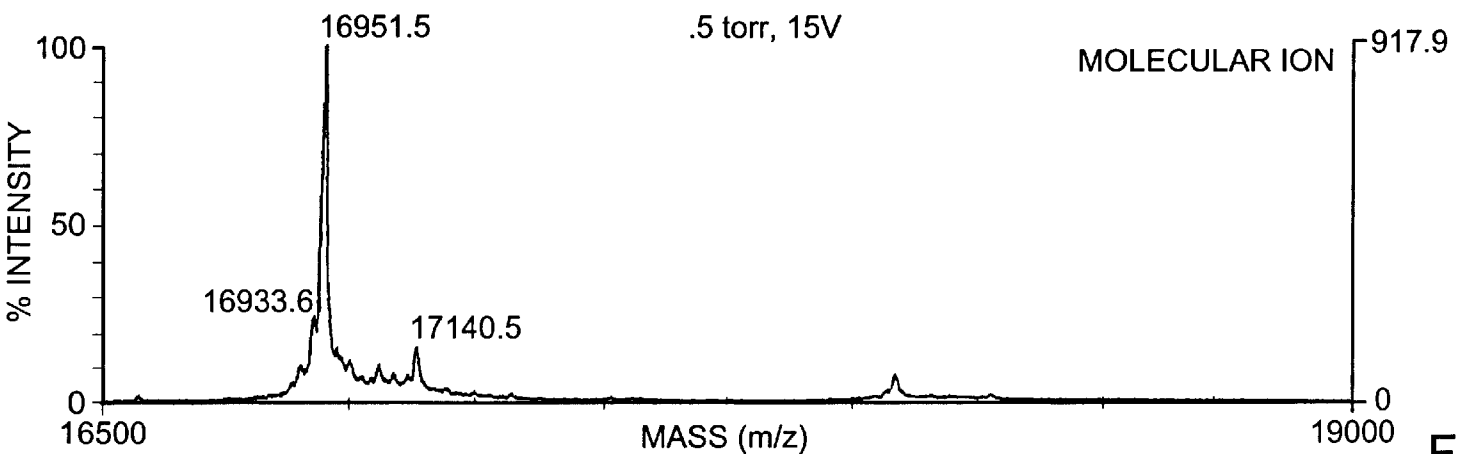
Figure 13C:
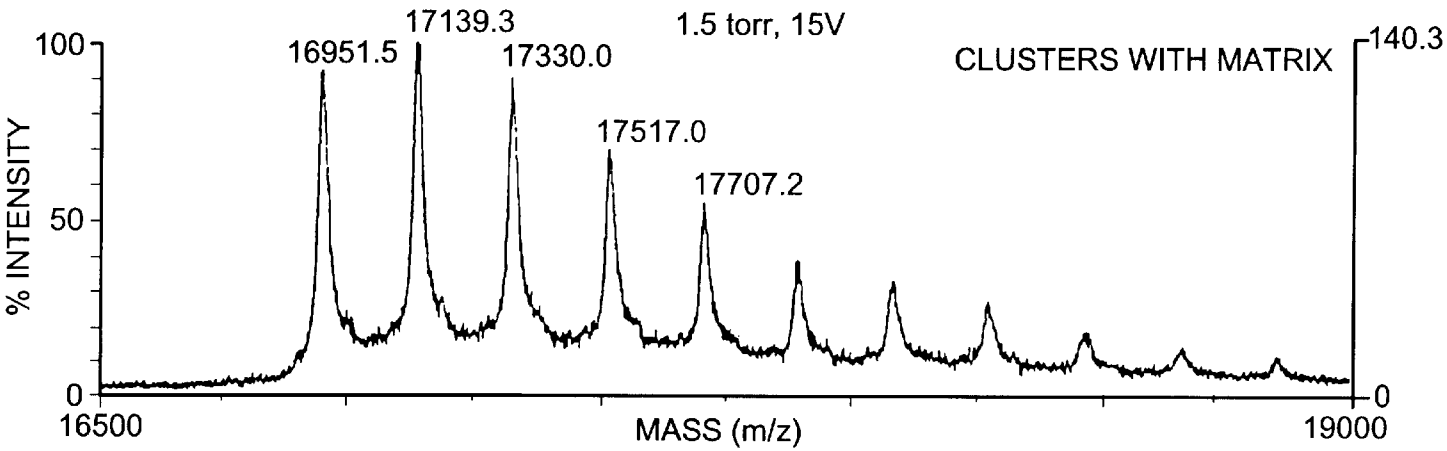
Figure 13D:
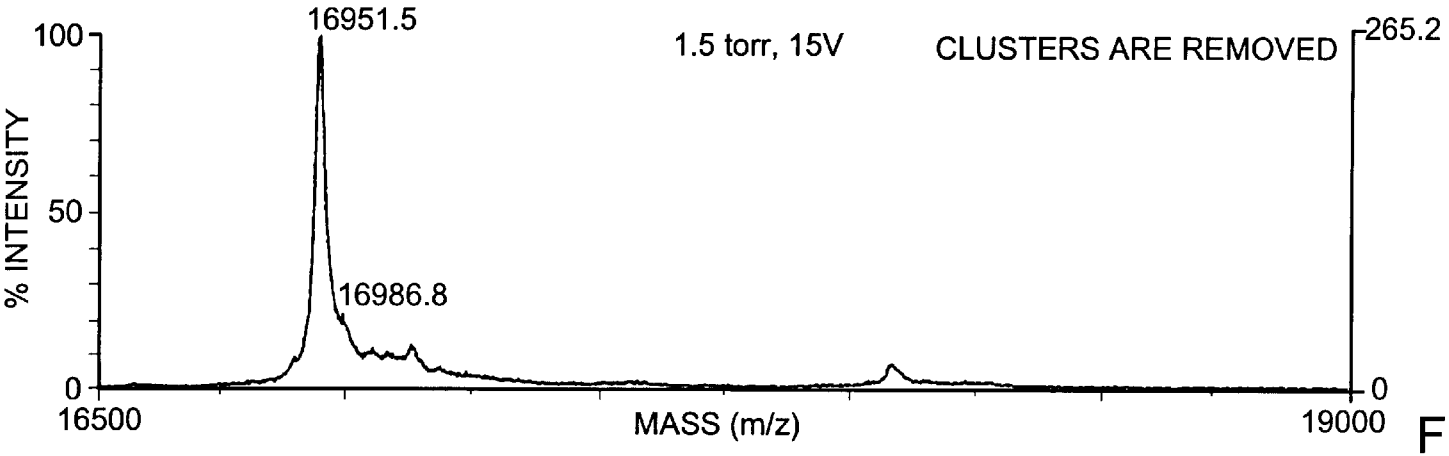
Figure 14A:
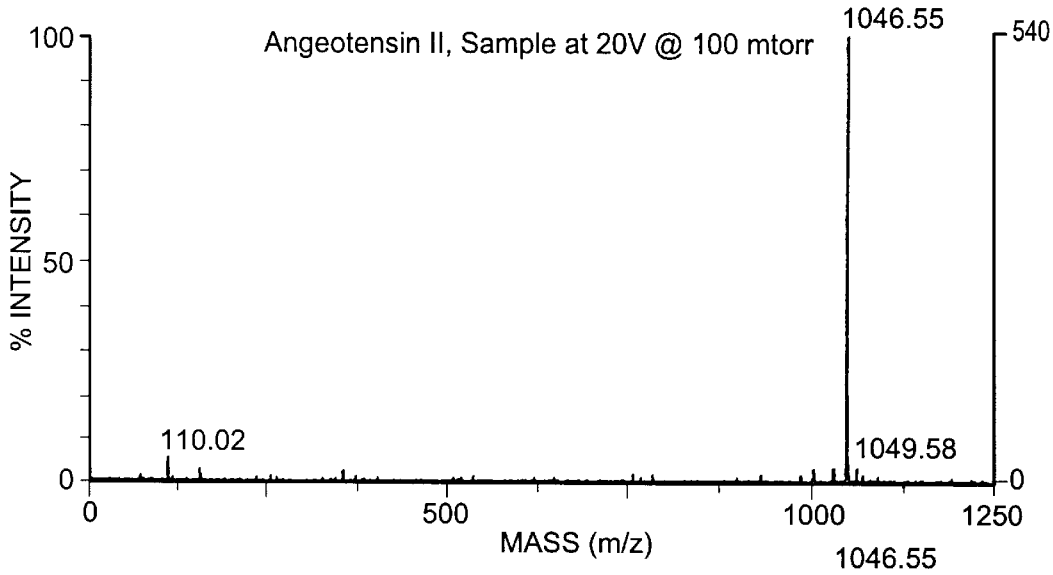
FIGS. 14A and B show two TOF spectra demonstrating an in-source CID of peptide angiotensin II at 100 mtorr, useful in understanding this invention.
Figure 14B:
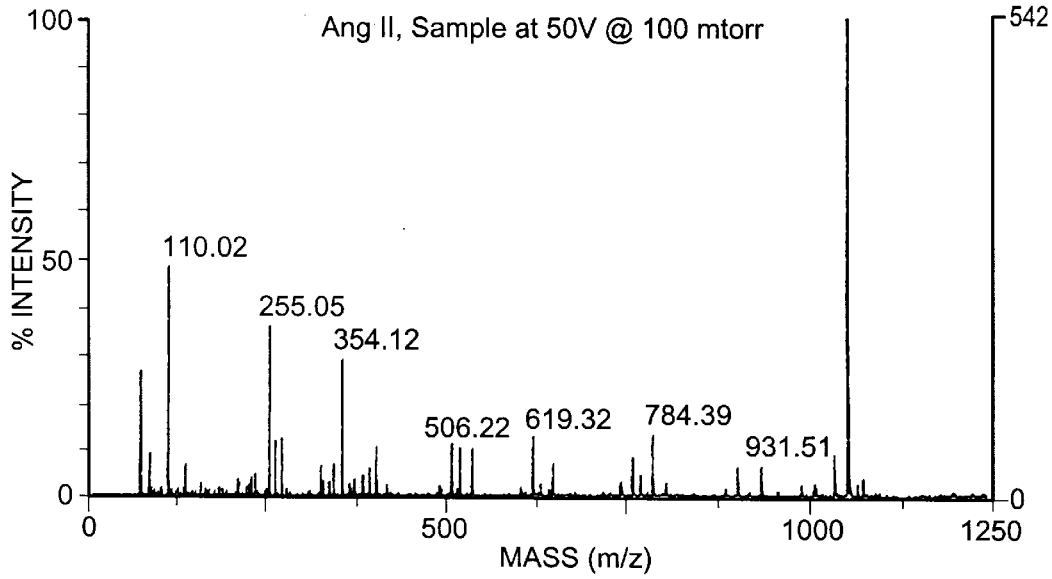

As has been demonstrated, increasing the ion source pressure stabilizes protein ions. With an increase in gas pressure, protein ions are relaxed and the amount of M-17 fragments is reduced (FIGS. 13A and B). However, further pressure increase is limited because at even higher pressure clusters are formed (FIG. 13C). These clusters can be removed by CID (FIG. 13D). For Myoglobin (17 kD), pressure increases from 0.2 torr to 0.5 torr have caused noticeable reduction of M-17 loss (FIGS. 13A and B). Further increase in the pressure suppresses M-17 peak even more (FIG. 13C). At the same time, such a pressure increase gives a quick rise to clusters of myoglobin ion with molecules of CHCA matrix. A similar process is observed for other tested matrices, sinapinic acid (SA) and 2,5-dihydroxy benzoic acid (DHB). Cluster abundance increases with laser energy, since more neutrals are emitted. The unwanted cluster peaks could be removed in the source by a collisional induced dissociation (CID). In the example of Myoglobin, clusters are removed (or prevented to form) at 1.5 torr by applying 100V to the sample plate. However, using CID is not the most effective solution for declustering, since it does allow analysis of mixtures. The required voltage depends on the size of the analyte ion. While described conditions (100V at 1.5 torr) are optimum for 15 kD protein (FIG. 13D), a medium size peptide shows a significant collisionally induced dissociation (FIG. 14B). FIGS. 14A and B demonstrate that mild conditions are achieved at potential gradient of 5 V per stage (FIG. 14A) and harsh conditions, at 50V bias on the sample plate (FIG. 14B). The inventors observed that removal of clusters by heat is more effective. Declustering in this way can be done without fragmenting smaller ions. Declustering in the transport system is a feature that also promotes decoupling of the MALDI ion source from the analyzer.

Figure 15A:
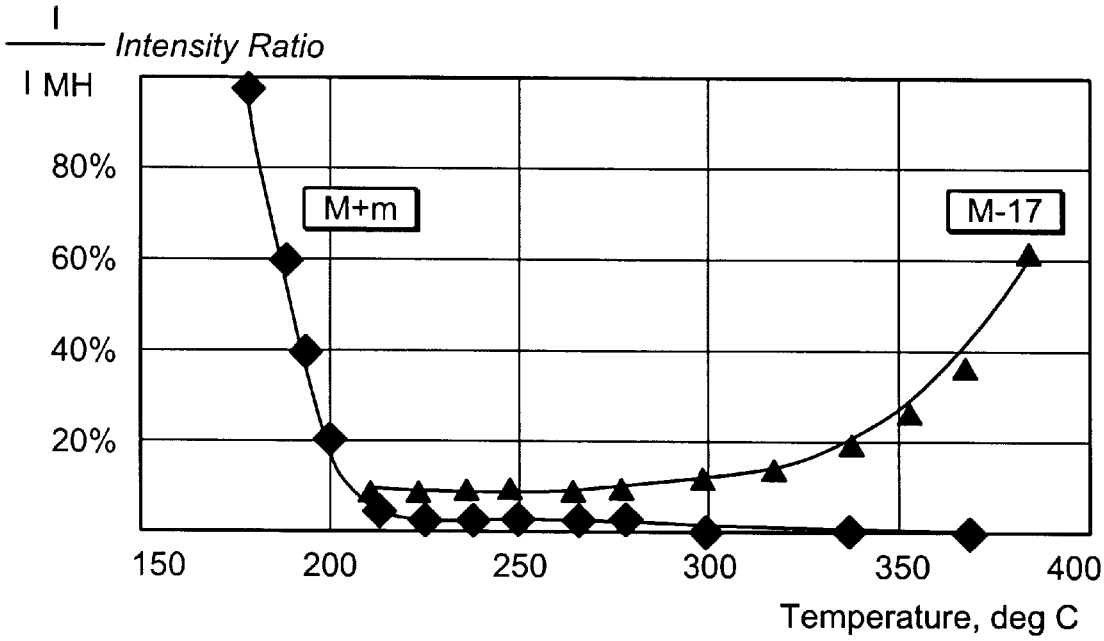
FIGS. 15A and B are plots representing thermal stability of biomolecules and their clusters, useful in understanding this invention.
Figure 15B:
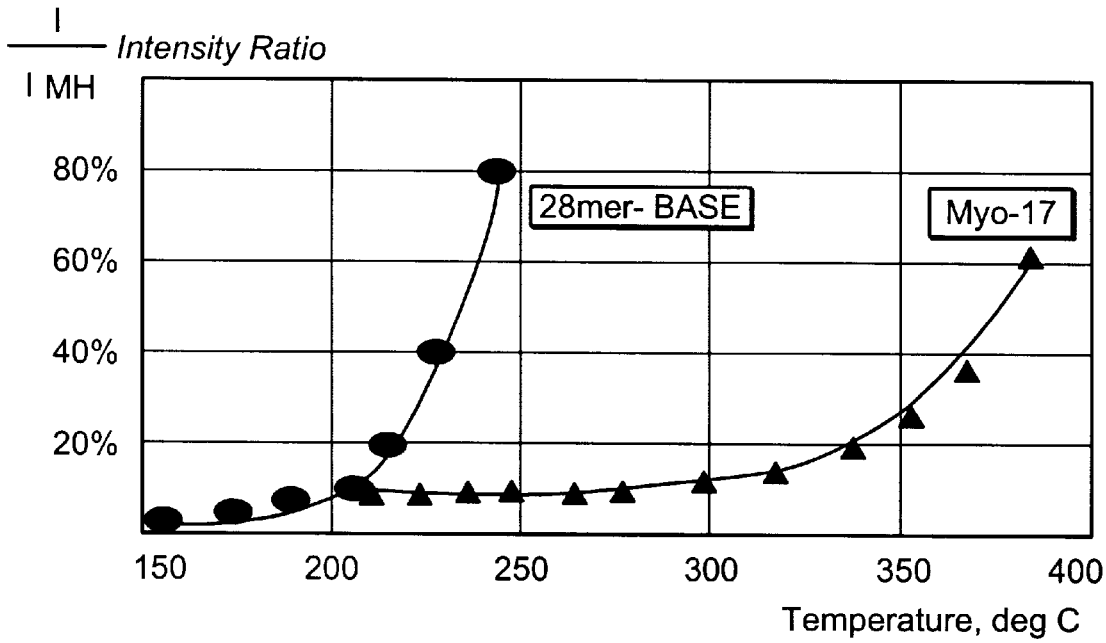

Referring to FIGS. 15A and B, there is a window of temperatures where clusters were removed from proteins without fragmenting proteins or small peptides. FIG. 15A demonstrates the relative intensity of molecular ion of protein myoglobin, its M-17 fragment and its complexes with matrix molecules, and FIG. 15B the relative intensity of fragments of protein myoglobin and 28-mer mixed base DNA. When a heated quadrupole was used in the transport system, this window was between 150 and 300° C. However, this temperature cannot be sustained in the ion source chamber due to possible decomposition of the sample on the sample plate. Accordingly, it is desirable to maintain the temperature in the ion source below 50° C. At higher temperature the proteins themselves break and lose small groups as is indicated by a curve of relative intensity of M-17 on FIG. 15A. DNA molecules appeared to be more fragile as is shown on FIG. 15B, and thus more gentle heating is required. The recommended temperature range is between 150° and 250° C.

Figure 16:
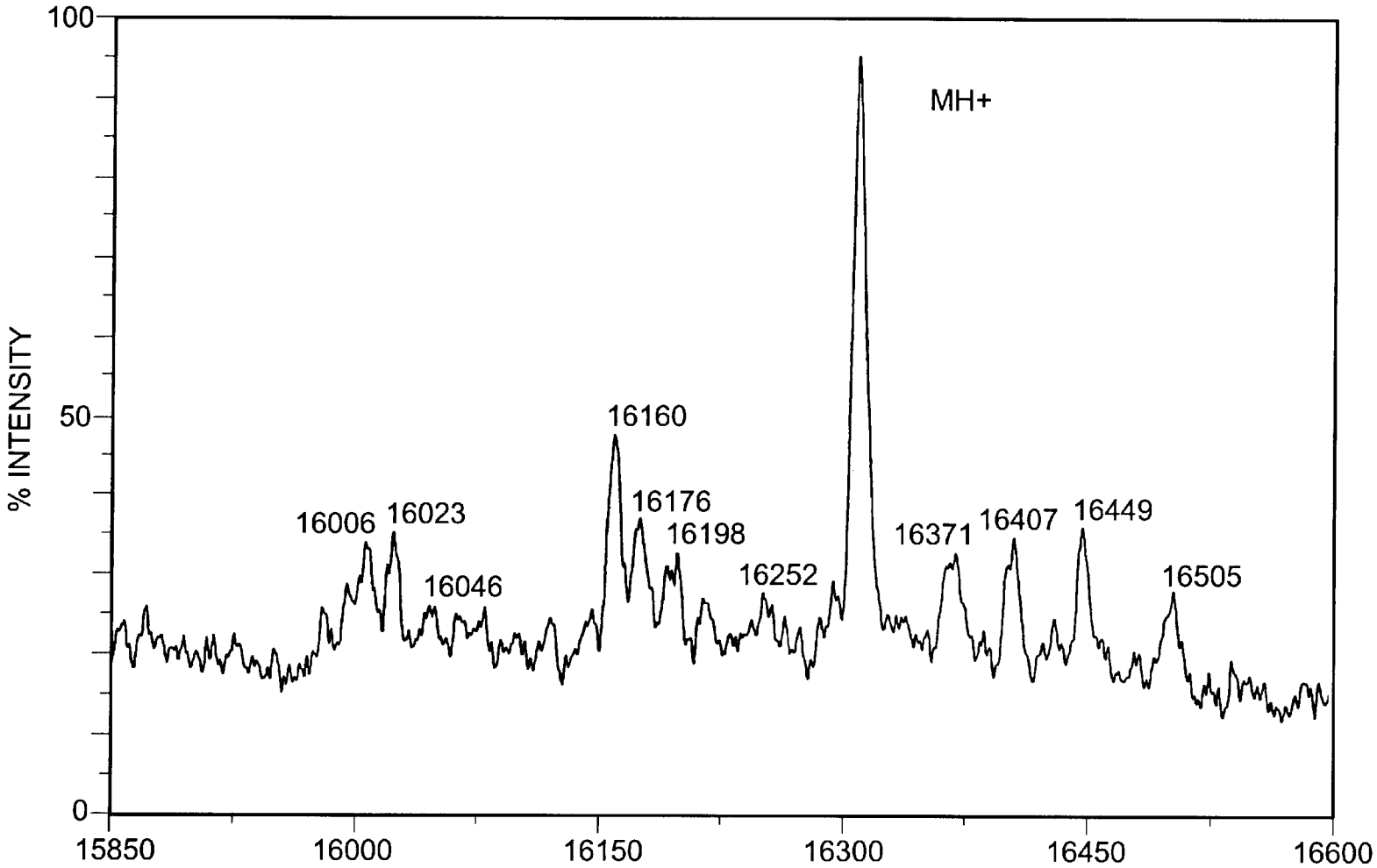
FIG. 16 is a spectrum of a 53-mer mixed base DNA with resolution (R) of 1800 on the molecular peak, useful in understanding this invention.

Referring to FIG. 16, there is shown a representative spectrum of a mid-mass DNA molecule, namely a mixed base 53-mer. The molecular peak is still a major peak in the spectrum. In addition, the spectrum contains peaks corresponding to the loss of various bases (from all monomers throughout the sequence). The next set of smaller mass peaks corresponds to DNA shorter by one nucleotide. These fragments are likely to occur during DNA synthesis. Again truncation is random throughout the entire sequence. Base losses indicate incomplete stabilization of DNA ions in gas collisions. Although collisional cooling is not totally effective to prevent DNA fragmentation, the present method provides a resolution (R) of 1800, which far exceeds the values obtainable from the analysis of the same size DNA using conventional techniques, such as by DE MALDI.

Conclusions

Performance of MALDI method for proteins is improved by increasing the gas pressure in the ion source above 0.1 torr.

Gas collisions are demonstrated to suppress fragmentation of peptide and protein ions generated in MALDI. Backbone fragmentation and loss of small groups are almost eliminated at a gas pressure of about 1 torr. Collisional cooling is particularly important for analysis of heavier proteins, since the amount of fragments goes up with analyte mass. The collisional cooling effect is attributed to relaxation of the internal energy of the ions.

Efficient cooling allows operation at higher laser energy-typically three-fold higher than the threshold energy for ionization, thereby improving ion signal and spot-to-spot reproducibility.

Increasing the ion source gas pressure above 1 torr causes the formation of clusters of protein ions with matrix molecules, which can be controlled by raising downstream gas temperature while the gas pressure is below 10 torr.

For peptides and small proteins the formation of clusters can be suppressed by in-source collisionally induced fragmentation. Thus clusters are formed in the source. For larger proteins, it is more efficient to utilize heating of the downstream gas. There is a window of temperatures where clusters are effectively suppressed without fragmenting protein ions.

Collisional cooling and cluster removal in the ion transport system provide even stronger decoupling of the ion source, and allow even higher flexibility in the choice of source conditions.

Control over the degree of excitation of ions improves the quality of protein spectra.

Collisional relaxation of DNA molecules has been achieved with some success despite some evidence of fragmentation. However, the method of the invention significantly improves resolution when analyzing mid-mass DNA molecules.

Although the specific features of this invention are shown in some drawings and not others, this is for convenience only, and the features may be combined as would be apparent to one of skill in the field. Other embodiments will occur to those of skill in the field from the foregoing description.

What is claimed is:

1. An apparatus for determining the molecular weight of samples of interest comprising:

a sample plate for containing the samples of interest and a matrix material;

a pulsed laser directed at said plate for generating a pulsed plume of sample ions within an ionization region adjacent to said plate;

an ion source chamber surrounding said ionization region and said sample plate, having an inlet for introducing a flow of gas into said ionization region, and an ion sampling aperture for limiting gas flow from said chamber, the gas pressure within said ion source being between about 0.1 torr and 10 torr;

a mass analyzer coupled to said chamber;

a transport module for transferring sample ions from said chamber via said ion sampling aperture to said mass analyzer; and a temperature controller coupled to said transport module;

wherein the temperature in said transport module is controlled between 150° C. and 300° C.

2. The apparatus of claim 1 wherein said mass analyzer is one of the following types, a quadrupole, an ion trap, a Fourier Transform or a magnet sector mass analyzer.

3. The apparatus of claim 1 wherein said mass analyzer is a time-of-flight mass analyzer.

4. The apparatus of claim 3 wherein said time-of-flight analyzer is substantially co-axial with the direction of ion travel through said transport module and wherein ions are pulse extracted from said transport module with a time delay after initiation of a laser pulse.

5. The apparatus of claim 3 wherein said time-of-flight analyzer is substantially orthogonal to the direction of ion travel through said ion transport module.

6. The apparatus of claim 4 including a pressure controller adapted to generate pulses of gas synchronized with the laser pulses and wherein said pump evacuates said ion source chamber between gas pulses.

7. The apparatus of claim 5 wherein said transport module comprises a long tube, said tube being heated by said temperature controller.

8. The apparatus of claim 7 wherein the product of the diameter of said tube times pressure in said ion source chamber is higher than 50 mm*torr.

9. The apparatus of claim 7 wherein the pressure in said ion source chamber is maintained between 3 torr and 1 atmosphere.

10. The apparatus of claim 7 wherein the pressure in said ion source chamber is maintained at 1 atmosphere and the temperature of said long tube is maintained at approximately 200° C.

11. The apparatus of claim 10 wherein the temperature in said ion source chamber is maintained below 50° C.

12. The apparatus of claim 5 wherein said transport module comprises first and second RF excited multipole guides being differentially pumped therebetween.

13. The apparatus of claim 12 wherein at least one of said multipole guides is heated by a temperature source.

14. The apparatus of claim 13 wherein said at least one multipole guide is heated to between 150° C. and 200° C. and the pressure in said ion source chamber is maintained between about 100 mtorr and 3 torr.

15. The apparatus of claim 14 wherein the temperature in said ion source chamber is maintained below 50° C.

16. The apparatus of claim 5 including a shield electrode located between said sample plate and said ion transport module.

17. The apparatus of claim 3 wherein said laser is fired at an energy level at least two times greater than the threshold energy level required for sample ionization.

18. The apparatus of claim 1 wherein the mass analyzer includes an ion detector comprising a data acquisition device.

19. The apparatus of claim 18 wherein the repetition rate of the laser is controlled to maximize signal intensity while avoiding saturation of the data acquisition device.

20. The apparatus of claim 1 wherein the pressure in said ion source chamber is maintained at 1 torr and the temperature in said transport module is controlled between 150° C. and 250° C.

21. The apparatus of claim 1 wherein the temperature in said ion source chamber is maintained below 50° C.

22. The apparatus of claim 1 wherein said matrix material is selected from the group consisting of α-cyano-4-hydroxycinnamic acid (CHCAC), 3-hydroxypicolinic acid, 2,5-dihydroxy-, 2,3,4-trihydroxy-, and 2,4,6-trihydroxyacetophenones, 4-nitrophenol, 6-aza-2-thiothymine, 2,5-dihydroxybenzoic acid, sinapinic acid, dithranol, 2-aminobenzoic acid, 2-(4-hydroxyphenylazo) benzoic acid (HABA), ferulic acid, succinic acid, water, water/alcohol mixtures, water and polyalcohol mixtures, aromatic amines, and aromatic amines containing a hydroxyl functional group.

23. The apparatus of claim 1 wherein said matrix material is a volatile material.

24. The apparatus of claim 1 wherein the pressure in said ion source chamber is maintained at about 1 torr.

25. The apparatus of claim 1, further comprising means for controlling the laser repetition rate, and means for scanning the sample relative to the laser, such that a single sample spot is exposed to the laser for less than about 500 laser shots.

26. The apparatus of claim 1 wherein the samples of interest are proteins, peptides or DNA oligomers.

27. A method for determining the molecular weight of samples of interest using a MS apparatus that includes an ion source chamber having a gas inlet and an ion sampling outlet, and enclosing a sample plate, comprising the steps of:

depositing the sample of interest and a matrix material on said sample plate;

pulsing the sample and the matrix material with a laser to generate a pulsed plume of ions in an ionization region adjacent to said sample plate;

introducing a supply of gas into said ion source chamber adjacent to said ionization region to create a pressure within said chamber between 0.1 torr and 10 torr;

transporting the sample ions through said ion sampling aperture, through an interface module, to a mass analyzer; and controlling the temperature within said interface module between 150° C. and 300° C.

28. The method of claim 27 wherein said mass analyzer is a time-of-flight mass analyzer.

29. The method of claim 28 wherein the MS apparatus includes a data acquisition device.

30. The method of claim 29 including the step of controlling the repetition rate of the laser to maximize signal intensity while avoiding saturating the data acquisition device.

31. The method of claim 27 including further steps of controlling the sample plate temperature below about 50° C. and controlling gas temperature in the transport module between about 150 and about 250° C.

32. The method of claim 27 wherein said time-of-flight analyzer is substantially co-axial with the direction of ion travel through said transport module and wherein the pulsed nature of the ion beam is preserved in said ion transport module.

33. The method of claim 32 including the steps of generating gas pulses synchronously with the laser pulses, and evacuating said ion source chamber between gas pulses.

34. The method of claim 27 wherein said time-of-flight analyzer is substantially orthogonal to the direction of ion travel through said ion transport module and wherein the ion beam is time spread in the ion transport module to be wider than the period between laser pulses.

35. The method of claim 27 wherein the laser repetition rate is higher than 20 Hz and preferably in the kiloherz range.

36. The method of claim 35 wherein said laser is fired at an energy level at least two times greater than the threshold energy level required for ionization.

37. The method of claim 27 including the further steps of controlling the laser repetition rate, and scanning the sample relative to the laser, such that a single sample spot is exposed to the laser for less than about 500 laser shots.

38. The method of claim 27 including the further step of controlling the sample plate temperature below about 50° C.

39. The method of claim 27 wherein the samples of interest are proteins, peptides or DNA oligomers.

40. An apparatus for determining the molecular weight of samples of interest comprising:

a sample plate for containing the samples of interest and a matrix material;

a pulsed laser directed at said plate for generating a pulsed plume of sample ions within an ionization region adjacent to said plate;

an ion source chamber surrounding said ionization region and said sample plate, having an inlet for introducing a flow of gas into said ionization region, and an ion sampling aperture for limiting gas flow from said chamber;

a mass analyzer coupled to said chamber;

a transport module for transferring sample ions from said chamber via said ion sampling aperture to said mass analyzer; and a temperature controller coupled to said transport module;

wherein the temperature in said transport module is controlled between 150° C. and 300° C.

41. The apparatus of claim 40 wherein said mass analyzer is a time-of-flight mass analyzer.

42. The apparatus of claim 41 wherein said time-of-flight analyzer is substantially co-axial with the direction of ion travel through said transport module and wherein ions are pulse extracted from said transport module with a time delay after initiation of a laser pulse.

43. The apparatus of claim 41 wherein said time-of-flight analyzer is substantially orthogonal to the direction of ion travel through said transport module.

44. The apparatus of claim 40 wherein the temperature in said ion source chamber is maintained below 50° C.

* * * * *